US006733119B2

(12) United States Patent
Naniwa et al.

(10) Patent No.: US 6,733,119 B2
(45) **Date of Patent: *May 11, 2004**

(54) INK JET PRINTING PROCESS AND PRINTING APPARATUS

(75) Inventors: Mutsumi Naniwa, Shizuoka (JP); Yusuke Nakazawa, Shizuoka (JP); Sadao Ohsawa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 6 days.

This patent is subject to a terminal disclaimer.

(21) Appl. No.: 10/140,203

(22) Filed: May 8, 2002

(65) Prior Publication Data

US 2002/0171724 A1 Nov. 21, 2002

Related U.S. Application Data

(63) Continuation of application No. 09/902,706, filed on Jul. 12, 2001, now Pat. No. 6,454,401.

(30) Foreign Application Priority Data

Jul. 12, 2000 (JP) ..... P. 2000-211413

(51) Int. Cl.[7] ..... B41J 2/18; B41J 2/175

(52) U.S. Cl. ..... 347/89; 347/85

(58) Field of Search ..... 347/19, 33, 75, 347/85, 87, 89, 100; 250/575

(56) References Cited

U.S. PATENT DOCUMENTS

| | | | | |
|---|---|---|---|---|
| 4,947,190 | A | 8/1990 | Mizusawa et al. | |
| 5,241,189 | A | 8/1993 | Vandagriff et al. | |
| 5,534,904 | A | 7/1996 | Sheinman | |
| 6,039,442 | A | 3/2000 | Hagiwara et al. | |
| 6,089,693 | A | 7/2000 | Drake et al. | |
| 6,454,401 | B2 * | 9/2002 | Naniwa et al. | 347/89 |

FOREIGN PATENT DOCUMENTS

| | | |
|---|---|---|
| JP | 10-286939 | 10/1998 |

* cited by examiner

*Primary Examiner*—Anh T. N. Vo
(74) *Attorney, Agent, or Firm*—Sughrue Mion, PLLC

(57) ABSTRACT

An ink jet printing process for forming an image directly on a printing medium by an electrostatic ink jet method of ejecting an oil ink using electrostatic field based on signals of image data and preparing a printed matter by fixing the image and an ink jet printing apparatus comprising image-forming means of forming an image directly on a printing medium based on signals of image data and image-fixing means of fixing the image formed by the image-forming means to obtain a printed matter, the image-forming means being an ink jet drawing device of ejecting an oil ink from an ejection head using electrostatic field.

16 Claims, 13 Drawing Sheets

INK JET PRINTING PROCESS AND PRINTING APPARATUS

This is a continuation of application Ser. No. 09/902,706 filed Jul. 12, 2001; now U.S. Pat. No. 6,454,401 the disclosure of which is incorporated herein by reference.

FIELD OF THE INVENTION

The present invention relates to a printing process and a printing apparatus for forming a printing image directly on a printing medium, more specifically, the present invention relates to an ink jet printing process and a printing apparatus, where a printing image is directly formed on a printing medium by an ink jet method of ejecting an oil ink using electrostatic field and where high-quality printing image and high-speed printing can be obtained.

BACKGROUND OF THE INVENTION

The printing process for forming a printing image on a printing medium based on image data signals includes an electrophotographic method, a sublimation-type or melting-type heat-transfer method and an ink jet method.

The electrophotographic method requires a process of forming an electrostatic latent image on a photoreceptor drum by electrification and exposure and therefore, suffers from complicated system and expensive apparatus.

The heat-transfer method uses an ink ribbon and therefore, despite its inexpensive apparatus, suffers from high running cost and treatment of a waste material.

The ink jet method performs the printing directly on a printing medium by ejecting an ink only on a desired image area using an inexpensive apparatus and therefore, ensures efficient use of coloring material and low running cost.

With respect to the method for applying the ink jet technology to printing system, for example, JP-A-10-286939 (the term "JP-A" as used herein means an "unexamined published Japanese patent application") discloses a process for additionally printing variable numbers, marks or the like on the same printing paper using the ink jet system by providing an ink jet printing apparatus to a rotary printing press.

The printing of image information is preferably in a level as high as comparable to the photographic image, however, conventional ink technologies of pressure-ejecting an aqueous or organic solvent-type ink containing a dye or pigment as a coloring material is disadvantageous in that since a droplet containing a large amount of a solvent is ejected, unless expensive exclusive paper is used, the printing image blurs.

Accordingly, in the case of performing the printing on a normal printing paper sheet or a non-absorptive medium such as plastic sheet, a high-quality printing image cannot be obtained.

As one of the ink jet technologies, a method of heat-melting an ink which is solid at an ordinary temperature, and jetting out the obtained liquid ink to form an image is known. When this ink is used, blurring of the printing image may be reduced, however, because of high viscosity of the ink at the ejection, a fine droplet cannot be jetted out and the obtained individual dot images are large in both the area and the thickness, as a result, a high-precision image cannot be formed.

In recent years, an ink jet method of ejecting an oil ink using electrostatic field has been proposed. In this ink jet method by the ejection of an oil ink, ink stirring means is provided in the ink tank so as to prevent the precipitation and coagulation of the oil ink. The stirring means used is a circulation pump, a stirring blade, an undulator or the like. In the case of a circulation pump, a pump for exclusive use of stirring is generally provided. Since a liquid feed pump for feeding an ink to the ejection head is provided, at least 2 pumps are provided and this is one obstacle to the simplification, miniaturization and reduction in the cost.

SUMMARY OF THE INVENTION

The present invention has been made by taking account of the above-described problems and the object of the present invention is to provide an ink jet printing process capable of printing a printed matter having a clear and high-quality image by an inexpensive apparatus and a simple and easy method, where the feed of ink to the ejection head and the prevention of precipitation and coagulation of ink can be attained at the same time by a simpler construction than in conventional processes.

In order to attain this object, according to the invention of an ink jet printing process described in claim 1, an ink jet printing process for forming an image directly on a printing medium by an electrostatic ink jet method of ejecting an oil ink using electrostatic field based on signals of image data and preparing a printed matter by fixing said image is provided, wherein the process uses an ink tank for storing the oil ink, an ink circulation line for stirring an oil ink stored in the ink tank, and an ink feed line for feeding the oil ink to an ink jet ejection head, branched from the ink circulation line, and wherein, an ink is circulated to the ink circulation line to simultaneously perform the stirring of ink stored in the ink tank and the feeding of ink to the ink jet ejection head.

According to the invention described in claim 2, in the ink jet printing process of claim 1, an ink recovery line for recovering the oil ink from the ink jet ejection head, connected to the ink circulation line, is provided and an ink is circulated to the ink circulation line to recover the ink from the ink jet ejection head.

According to the invention described in claim 3, in the ink jet printing process of claim 1 or 2, the oil ink is obtained by dispersing at least colored particles in a nonaqueous solvent having an electric resistivity of $10^9$ Ωcm or more and a dielectric constant of 3.5 or less.

According to the invention of an ink jet printing apparatus described in claim 4, an ink jet printing apparatus comprising image-forming means of forming an image directly on a printing medium based on signals of image data and image-fixing means of fixing the image formed by the image-forming means to obtain a printed matter, the image-forming means being an ink jet drawing device of ejecting an oil ink from an ejection head using electrostatic field, is provided, wherein the image-forming means comprises an ink jet ejection head, ink feed means of feeding the oil ink to the ink jet ejection head, an ink tank for storing the oil ink and ink circulation means of stirring an oil ink stored in the ink tank, and the ink feed means is branched from the ink circulation means.

According to the invention described in claim 5, in the ink jet printing apparatus of claim 4, ink recovery means of recovering the oil ink from the ink jet ejection head is provided and the ink recovery means is connected to the ink circulation means.

According to the invention described in claim 6, in the ink jet printing apparatus of claim 4 or 5, the oil ink is obtained by dispersing at least colored particles in a nonaqueous solvent having an electric resistivity of $10^9$ Ωcm or more and a dielectric constant of 3.5 or less.

According to the invention described in claim 7, in the ink jet printing apparatus in any one of claims 4 to 6, the image-forming means has a fixing apparatus for fixing the ink.

According to the invention described in claim 8, the ink jet printing apparatus in any one of claims 4 to 8 comprises dust-removing means of removing dusts present on the surface of the printing medium before and/or during the printing on the printing medium.

According to the invention described in claim 9, in the ink jet printing apparatus in any one of claims 4 to 8, at the time of drawing an image on the printing medium, the drawing is performed by rotating an opposing drum disposed at the position facing the ejection head through the printing medium and thereby moving the printing medium.

According to the invention described in claim 10, in the ink jet printing apparatus of claim 9, the ejection head comprises a single channel head or a multi-channel head and the drawing is performed by moving the head in the direction parallel to the axis of the opposing drum.

According to the invention described in claim 11, in the ink jet printing apparatus in any one of claims 4 to 7, at the time of drawing an image on the printing medium, the drawing is performed by running the printing medium while interposing and holding it between at least a pair of capstan rollers.

According to the invention described in claim 12, in the ink jet printing apparatus of claim 11, the ejection head comprises a single channel head or a multi-channel head and the drawing is performed by moving the ejection head in the direction orthogonal to the running direction of the printing medium.

According to the invention described in claim 13, in the ink jet printing apparatus of claim 9 or 11, the ejection head comprises a full line head having almost the same length as the width of the printing medium.

According to the invention described in claim 14, in the ink jet printing apparatus in any one of claims 4 to 13, the ink jet drawing device has ink temperature-controlling means of controlling the temperature of the oil ink in the ink tank for storing the oil ink.

According to the invention described in claim 15, in the ink jet printing apparatus in any one of claims 4 to 14, the ink jet drawing device has concentration-controlling means of controlling the concentration of the oil ink.

According to the invention described in claim 16, the ink jet printing apparatus in any one of claims 4 to 15 comprises cleaning means of cleaning the ejection head.

DESCRIPTION OF NUMERICAL REFERENCES

Figure 1:
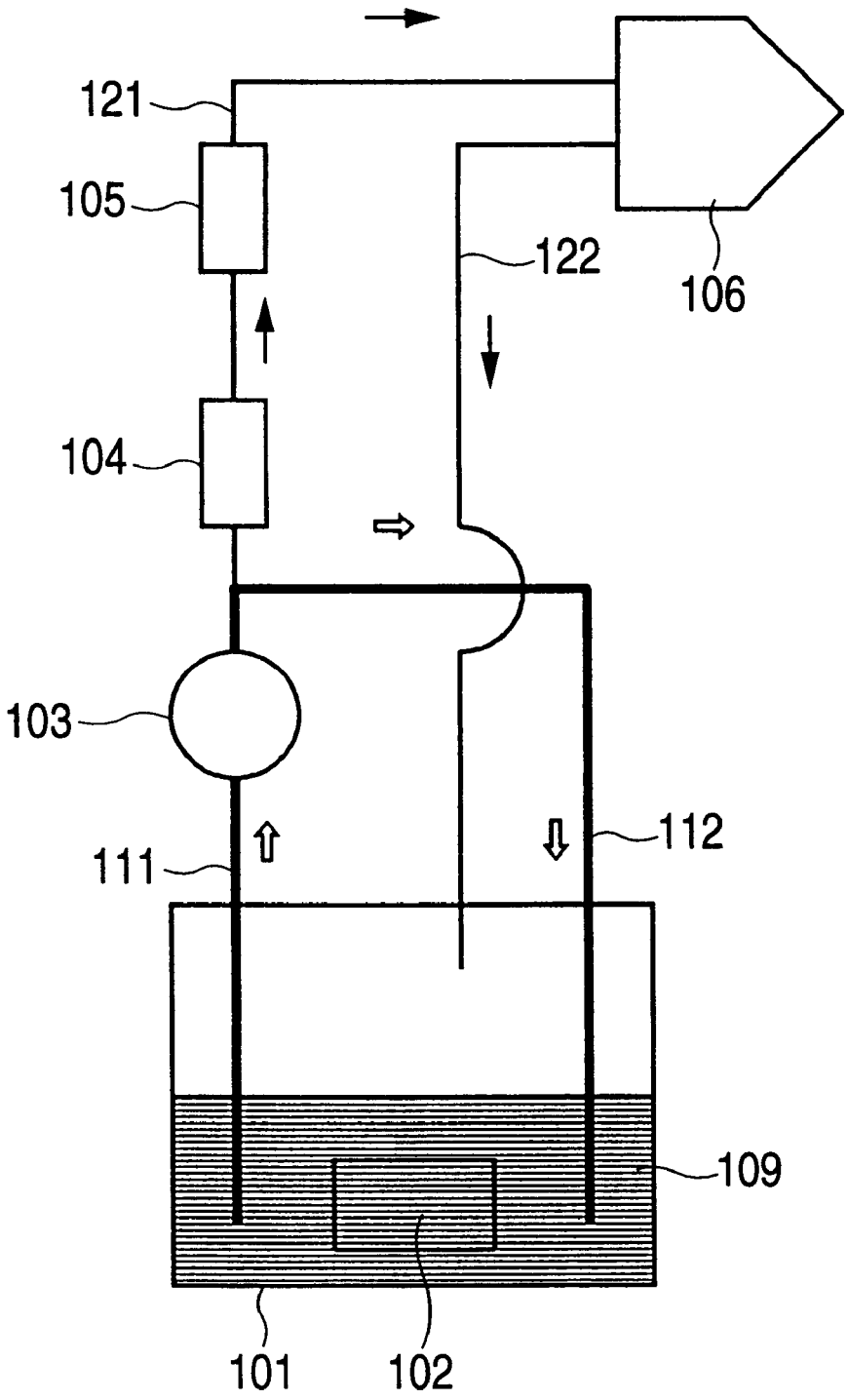
FIG. 1 is a view showing an ink stirring device and a liquid feed device according to the first embodiment of the present invention.

| | |
|---|---|
| 1 | printing medium feed roll |
| 2 | dust-removing device |
| 3 | ink ejection drawing device |
| 4 | opposing (drawing) drum |
| 5 | fixing apparatus |
| 6 | printing medium take-up roll |
| 7 | automatic discharge device |
| 8 | cutter |
| 9 | automatic feed device |
| 10 | capstan roller |
| 11 | earthing means |
| 20 | ink jet recording device |
| 21 | image data arithmetic and control part |
| 22 | ejection head |
| 221 | upper unit |
| 222 | lower unit |
| 22a | ejection slit |
| 22b | ejection electrode |
| 23 | oil ink |
| 24 | ink feed part |
| 25 | ink tank |
| 26 | ink feed device |
| 27 | stirring means |
| 28 | ink temperature-controlling means |
| 29 | ink concentration-controlling means |
| 30 | encoder |
| 31 | head-retreating or approximating device |
| 32 | head sub-scanning means |
| 33 | first insulating substrate |
| 34 | second insulating substrate |
| 35 | inclined face part of second insulating substrate |
| 36 | upper face part of second insulating substrate |
| 37 | ink inflow passage |
| 38 | ink recovery passage |
| 39 | backing |
| 40 | groove |
| 41 | head body |
| 42, 42' | meniscus regulating plates |
| 43 | ink groove |
| 44 | partition |
| 45, 45' | ejection parts |
| 46 | partition |
| 47 | distal end of partition |
| 50, 50' | support members |
| 51, 51' | groove |
| 52 | partition |
| 53 | upper end part |
| 54 | rectangular part |
| 55 | upper end of partition |
| 56 | guide projection |
| M | printing medium |
| 101 | ink tank |
| 102 | ink temperature-controlling means |
| 103 | large flow rate circulation pump |
| 104 | flow rate-controlling means in the feed side |
| 105 | ink concentration-controlling means |
| 106 | ejection head |
| 107 | flow rate-controlling means in the return side |
| 109 | ink |
| 111 | large aperture pipeline for circulation route (feed side) |
| 112 | large aperture pipeline for circulation route (return side) |
| 121 | small aperture pipeline for drawing route (feed side) |
| 122 | small aperture pipeline for drawing route (return side) |

DETAILED DESCRIPTION OF THE INVENTION

The present invention is described in detail below.

The present invention is characterized by forming an image on a printing medium fed to a printing apparatus, by an ink jet method of ejecting an oil ink using electrostatic field.

The ink jet method for use in the present invention is described in PCT Publication WO93/11866. In this ink jet method, an ink having high resistance obtained by dispersing at least colored particles in an insulating solvent is used, a strong electric field is allowed to act on this ink at the ejection position to form an agglomerate of colored particles at the ejection position, and the agglomerate is ejected from the ejection position using electrostatic means. As such, the colored particles are ejected as an agglomerate formed to a high concentration and the ink droplet contains only a small amount of solvent, whereby a high-density clear image free of blurring is formed on a recording medium such as printing paper sheet or printing plastic film.

In this ink jet method, the size of the ink droplet ejected is determined by the size of the ejection electrode tip or the conditions in forming the electric field. Therefore, when a small ejection electrode and appropriate electric field-forming conditions are used, a small ink droplet can be obtained without reducing the ejection nozzle size or slit width.

Accordingly, a fine image can be controlled without causing a problem of ink clogging in the head and the present invention provides an ink jet printing process capable of printing a printed matter having a clear and high-quality image.

Construction examples of the printing apparatus for use in practicing the ink jet printing process of the present invention are described below, however, the present invention is not limited to the following construction examples.

FIGS. 6 to 11 each is a view showing a schematic construction example of the printing apparatus according to the present invention, where the drawing is performed by rotating the opposing drum and thereby moving the printing medium.

Figure 6:
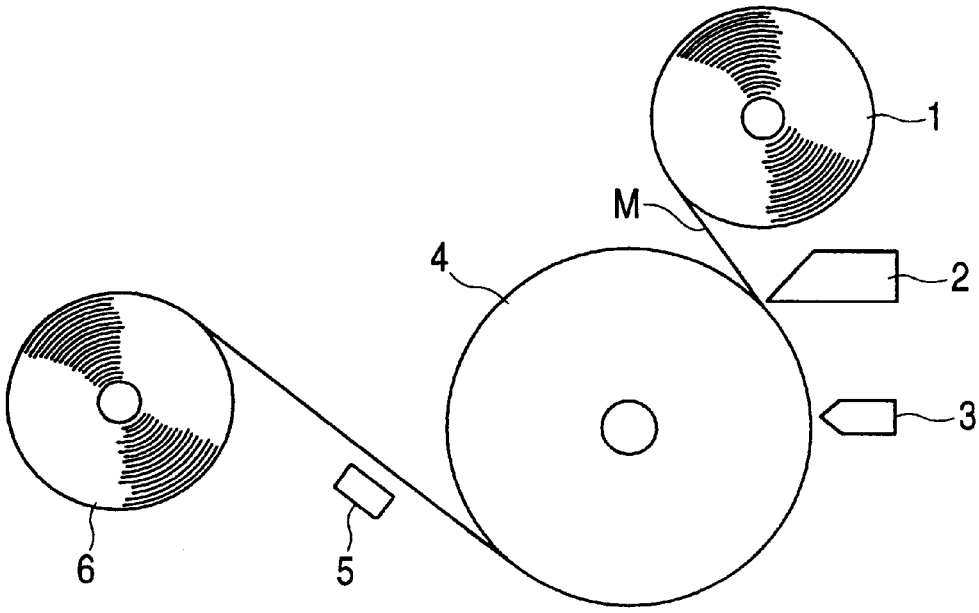
FIG. 6 is an entire construction view schematically showing a web-type apparatus for performing one-side monochromatic printing, which is one example of the ink jet printing apparatus of the present invention.
Figure 7:
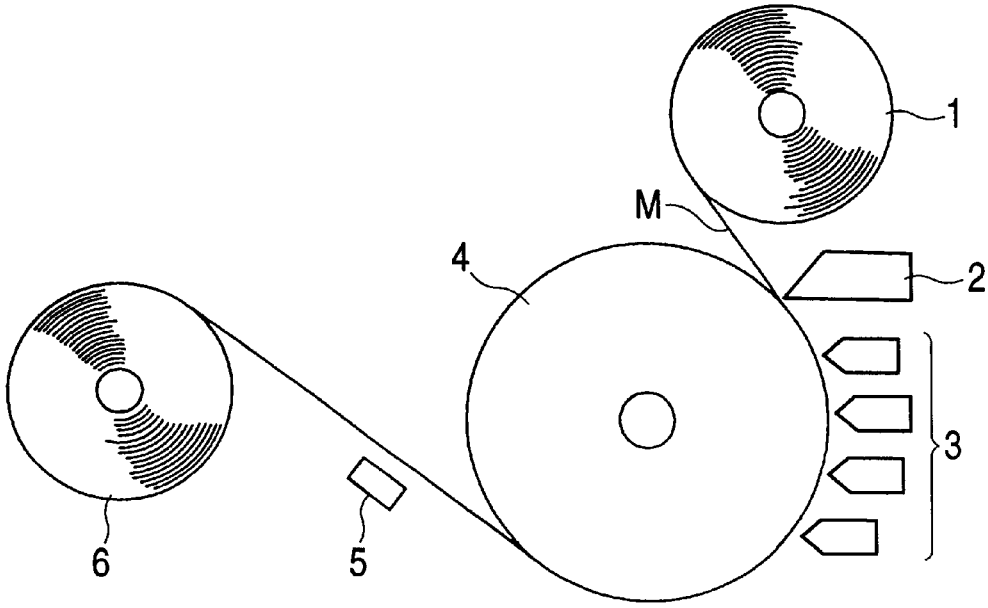
FIG. 7 is an entire construction view schematically showing a web-type apparatus for performing one-side four-color printing, which is another example of the ink jet printing apparatus of the present invention.

FIGS. 6 to 9 each is a view showing a schematic construction example of a web-type printing apparatus where a rolled printing medium is tensioned by putting it over an opposing drum, a printing medium feed roll and a printing medium take-up roll or a guide roll. Out of these schematic construction examples, FIG. 6 is a view showing a web-type apparatus for performing one-side monochromatic printing, FIG. 7 is a view showing a web-type apparatus for performing one-side four-color printing, and FIGS. 8 and 9 each is a view showing a two-side four-color printing apparatus.

Figure 10:
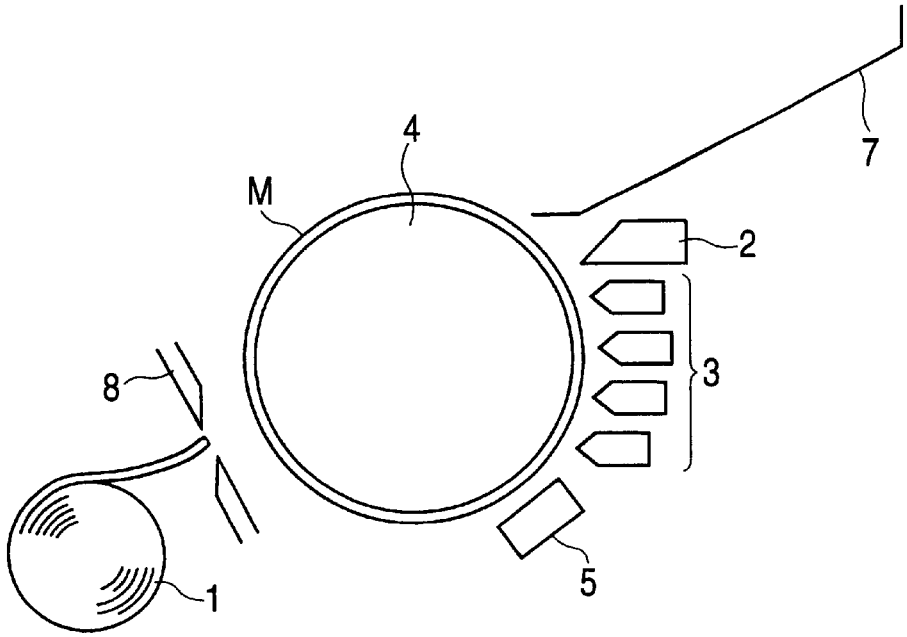
FIG. 10 is an entire construction view schematically showing a one-side four-color printing apparatus for performing the printing by cutting a rolled printing medium and winding it around an opposing drum, which is another example of the ink jet printing apparatus of the present invention.
Figure 11:
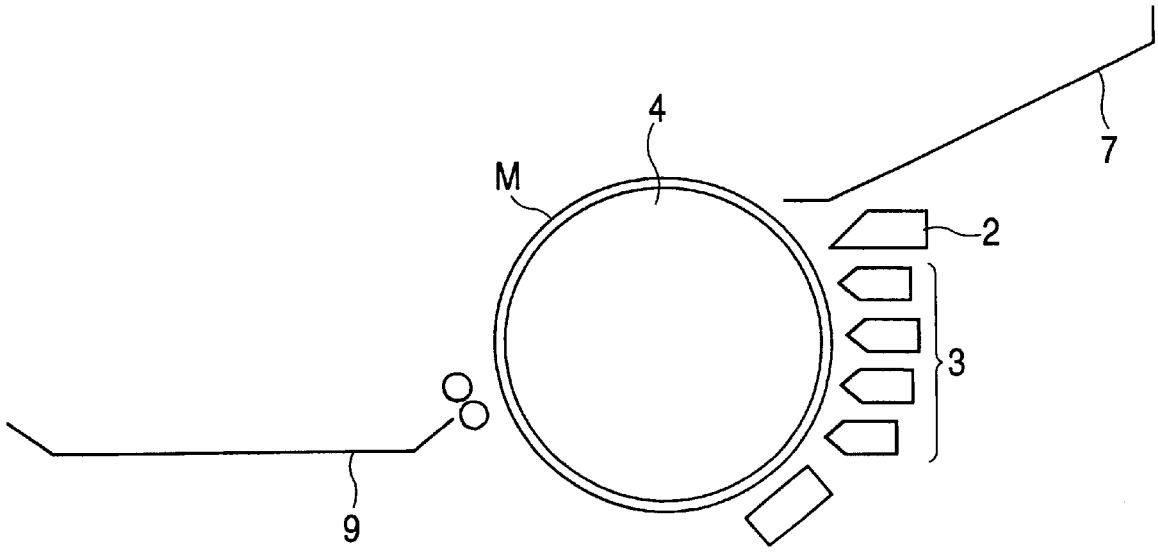
FIG. 11 is an entire construction view schematically showing a printing apparatus using a sheet-like recording medium, which is another example of the ink jet printing apparatus of the present invention.

FIG. 10 is a view showing a schematic construction example of a one-side four-color printing apparatus where the printing is performed by cutting a rolled printing medium and winding it around an opposing drum, and FIG. 11 is a view showing a schematic construction example of a printing apparatus using a sheet-like recording medium.

Figure 12:
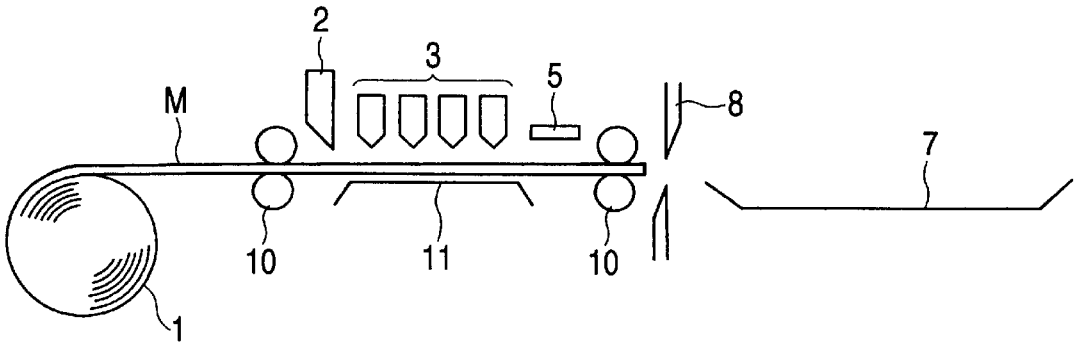
FIG. 12 is an entire construction view schematically showing a printing apparatus for performing the drawing by running a rolled printing medium while interposing and holding it between capstan rollers, which is another example of the ink jet printing apparatus of the present invention.
Figure 13:
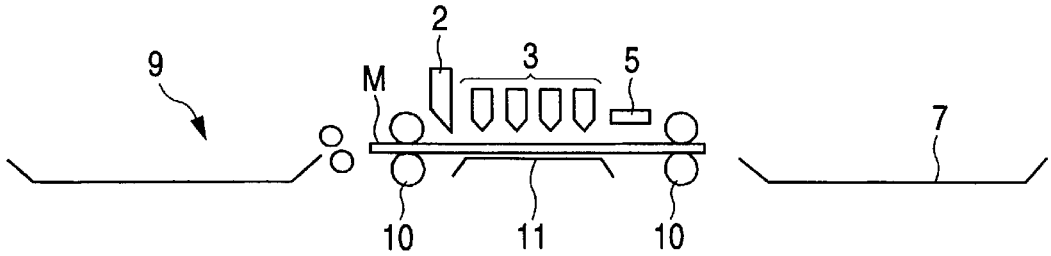
FIG. 13 is an entire construction view schematically showing a printing apparatus for performing the drawing by running a sheet-like recording medium while interposing and holding it between capstan rollers, which is another example of the ink jet printing apparatus of the present invention.

On the other hand, FIGS. 12 and 13 each is a view showing a schematic construction example of the printing apparatus according to the present invention, where the drawing is performed by running the printing medium while interposing and holding it between capstan rollers. Out of these schematic construction examples, FIG. 12 is a view showing a printing apparatus using a rolled printing medium and FIG. 13 is a view showing a printing apparatus using a sheet-like recording medium.

Figure 14:
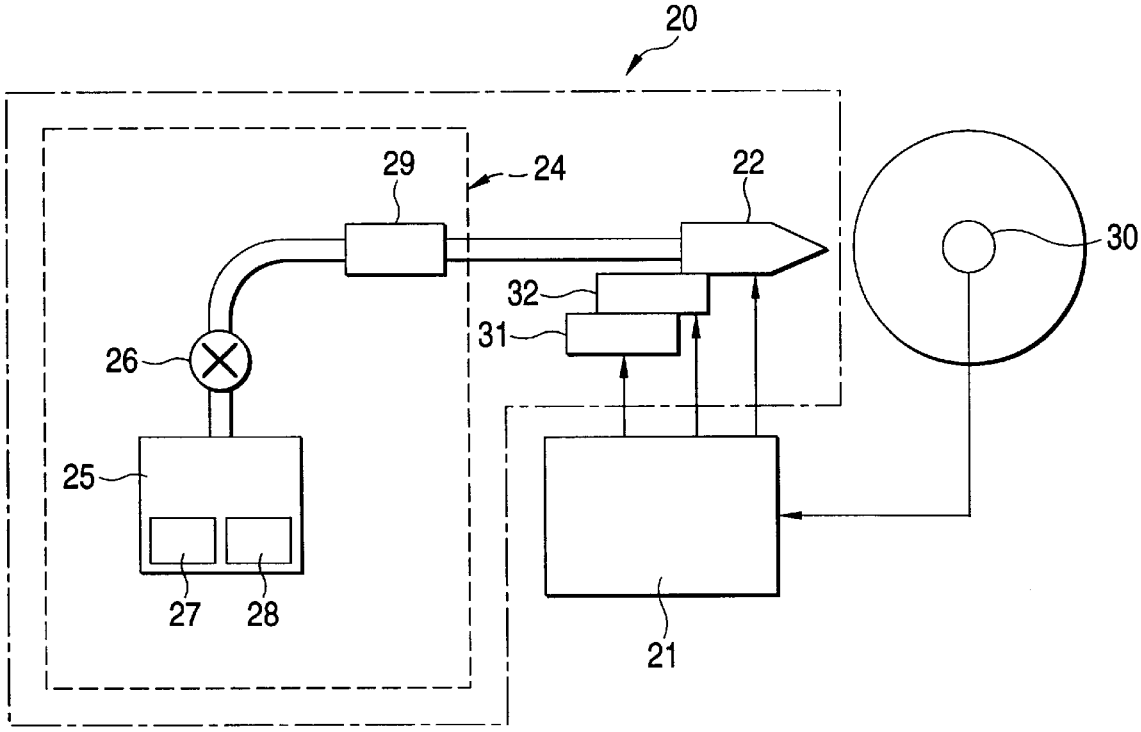
FIG. 14 is a schematic construction example of a drawing device of an ink jet printing apparatus of the present invention, including the control part, ink feed part and head-retreating or approximating mechanism of the drawing device.

FIG. 14 is a view showing a schematic construction example of a drawing device including the control part, the ink feed part and the head-retreating or approximating mechanism. FIGS. 15 to 21 each is a view for explaining the ink jet recording device of the drawing device shown in FIG. 14.

The printing step according to the present invention is described using the entire construction view of an apparatus for performing one-side monochromatic printing on a rolled printing medium shown in FIG. 6.

The ink jet printing apparatus (hereinafter sometimes referred to as a "printing apparatus") shown in FIG. 6 is constructed by a feed roll 1 for feeding a rolled printing medium, a dust/paper dust-removing device 2, a drawing device 3, an opposing (drawing) drum 4 disposed at the position facing the drawing device 3 through a printing medium, a fixing apparatus 5 and a printing medium take-up roll 6.

After dusts or the like on a printing medium delivered from a feed roll are removed by the dust/paper dust removing device 2, an ink is imagewise ejected from an ink ejection part (which is described later) of the drawing device 3 toward the printing medium on the drawing drum 4 and thereby, a printing image is recorded on the printing medium. This image is fixed on the printing medium using the fixing apparatus 5 and then the printing medium after the printing is taken up by the printing medium take-up roll 6.

The opposing (drawing) drum 4 serves as a counter electrode of the ejection electrode in the ink ejection part and therefore, a metal-made roll, a roll having on the surface thereof an electrically conducting rubber layer, or an insulating drum such as plastic, glass or ceramic after providing a metal layer on the surface thereof using vapor deposition, plating or the like is used. By using such a roll or drum, an effective electric field can be formed between the drawing device 3 and the ejecting part. For improving the quality of image drawn, it is also effective to provide heating means to the drawing drum 4 and elevate the drum temperature. The rapid fixing of the ejected ink droplets on the printing medium is accelerated and the blurring is more successfully prevented.

By controlling the drum temperature constant, the physical property values of the ink droplet ejected on the printing medium can be controlled and therefore, stable and homogeneous dot formation can be attained. In order to keep the drum at a constant temperature, cooling means is preferably provided together.

For the dust/paper dust-removing means, a known non-contact method such as suction removal, blowing removal or electrostatic removal, or a contact method by a brush, a roller or the like may be used.

In the present invention, either air suction or air blowing, or a combination thereof is preferably used.

The drawing device 3 has an ink jet recording device 20 shown in FIG. 14. The ink jet recording device 20 forms a drawn image by ejecting an oil ink on a printing medium in correspondence to the image data sent from the image data arithmetic and control part 21 using the electric field formed between the ejection head 22 and the opposing drum 4.

The image data arithmetic and control part 21 receives image data from an image scanner, a magnetic disc device, an image data transmission device or the like, performs color separation, then partitions and computes the separated data into an appropriate number of picture elements or an appropriate number of gradations, and shares these to respective heads.

Furthermore, since the oil ink image is drawn as a dotted image using the ink jet ejection head 22 (which is described later; see, FIG. 15) of the ink jet recording device 20, the halftone dot area factor is also computed.

As described later, the image data arithmetic and control part 21 controls the movement of the ink jet ejection head 22 and the timing of ejecting the oil ink and if desired, also controls the action timing of the printing medium.

The printing step by the printing apparatus is described in detail below by referring to FIGS. 6 and 14.

The printing medium delivered from the printing medium feed roll is tensioned by the driving of the printing medium take-up roll to abut on the drawing (opposing) drum, whereby the printing medium web is prevented from vibrating and contacting with the ink jet recording device to cause damages on drawing.

Also, means of closely contacting the printing medium with the drawing (opposing) drum only in the periphery of the drawing position of the ink jet recording device may be disposed and actuated at least at the time of performing the drawing, whereby the printing medium can be prevented from contacting with the ink jet recording device. More specifically, it is effective, for example, to dispose a presser roller upstream and downstream the drawing position of the drawing drum or to use a guide, electrostatic adsorption or the like.

The image data from a magnetic disc device or the like is given to the image data arithmetic and control part 21 and according to the input image data, the image data arithmetic and control part 21 computes the position of ejecting an oil ink and the halftone dot area factor at that position. These computed data are once stored in a buffer. The image data arithmetic and control part 21 approximates the ejection head 22 to the position proximate to the printing medium abutting on the drawing drum by a head-retreating or approximating device 31. The ejection head 22 and the surface of the drawing drum are kept at a predetermined distance during drawing using mechanical distance-controlling means such as knock roller or by the control of head-retreating or approximating device based on the signals from an optical distance detector. For the ejection head 22, a single channel head, a multi-channel head or a full line head may be used.

In the case of using a single channel head or a multi-channel head as the ejection head, the head is disposed such that the ejection parts are arrayed almost in parallel to the running direction of the printing medium and on printing, the main scanning is performed by the movement of the ejection head in the axial direction of the opposing drum and the sub-scanning is performed by the rotation of the opposing drum. The movements of the opposing drum and the ejection head are controlled by the image data arithmetic and control part 21 and the ejection head ejects an oil ink on the printing medium based on the ejection position and the halftone dot area factor obtained by the computation. By this ejection, a halftone image is drawn on the printing medium with the oil ink according to the variable density of the printing original. This operation continues until a predetermined ink image is formed on the printing medium.

On the other hand, in the case where the ejection head 22 is a full line head having almost the same length as the width of drum, the head is disposed to array the ejection parts nearly at a right angle to the running direction of the printing medium and an oil ink image is formed by passing the printing medium through the drawing part along the rotation of the opposing drum, whereby a printed matter is finished.

After the completion of printing, if desired, the ejection head 22 is retreated to come apart from the position proximate to the drawing drum so as to protect the ejection head 22. At this time, only the ejection 22 may be retreated but the ejection 22 and the ink feed part 24 may also be retreated together.

This retreating or approximating means is operated to separate the recording head at least 500 $\mu$m or more apart from the drawing drum except for the drawing time. The retreating/approximating operation may be performed by a slide system or by a pendulum system of fixing the head using an arm fixed to a certain axis and moving the arm around the axis. By retreating the head at the non-drawing time, the head can be protected from physical breakage or contamination and prolonged in the life.

The oil ink image formed is intensified by a fixing apparatus 5. For fixing the ink, known means such as heat fixing or solvent fixing may be used. In the heat fixing, hot air fixing by the irradiation of an infrared lamp, a halogen lamp or a xenon flash lamp or by the use of a heater, or heat roller fixing is generally employed. The flash fixing using a xenon lamp or the like is known as a fixing method of electrophotographic toner and this is advantageous in that the fixing can be performed within a short time. In the case of using a laminate sheet, the water content inside the paper abruptly evaporates due to abrupt elevation of the temperature and a phenomenon called blister of generating asperities on the paper surface takes place. Therefore, in view of preventing the blister, it is preferred to dispose a plurality of fixing machines and vary the distance from the power supply and/or the fixing machine to the recording medium so as to gradually elevate the paper temperature.

In the solvent fixing, a solvent capable of dissolving the resin components in the ink, such as methanol and ethyl acetate, is sprayed or the printing medium is exposed to the solvent vapor while recovering excess solvent vapor.

At least in the process from the formation of an oil ink image by the ejection head 22 until the fixing by the fixing apparatus 5, the image on the printing medium is preferably kept not to come into contact with any thing.

Figure 8:
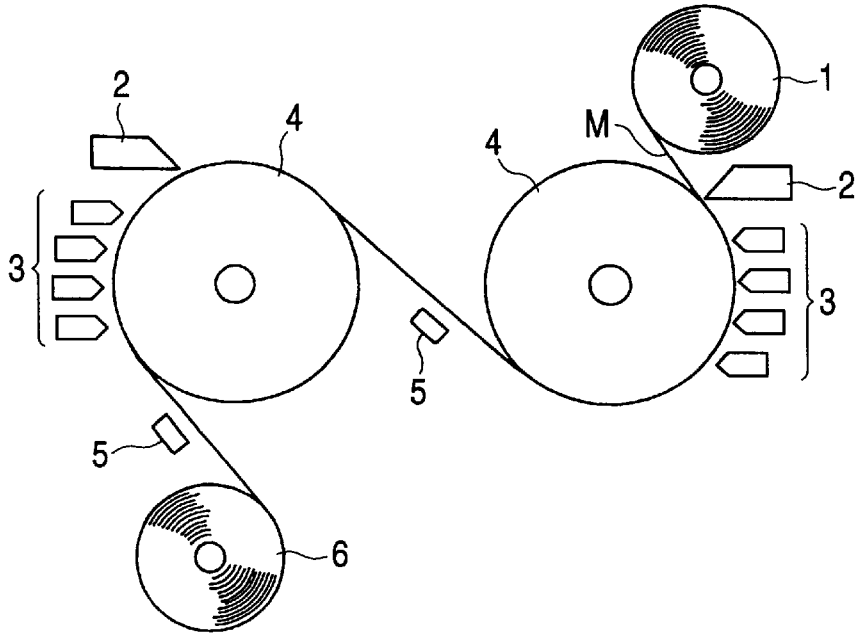
FIG. 8 is an entire construction view schematically showing a two-side four-color printing apparatus, which is another example of the ink jet printing apparatus of the present invention.
Figure 9:
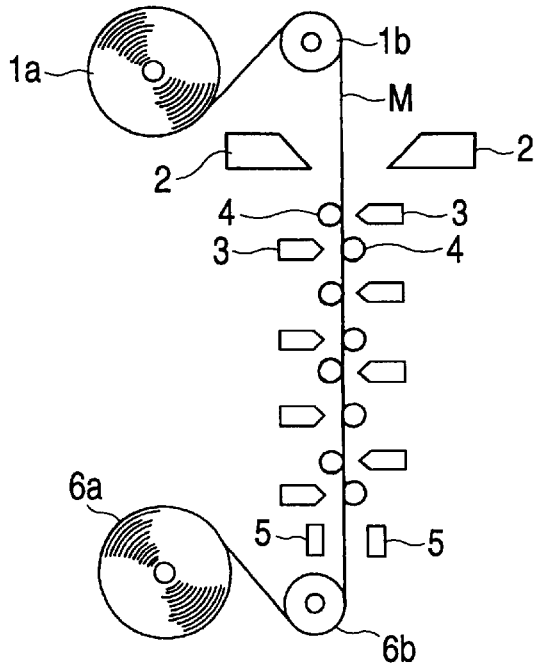
FIG. 9 is an entire construction view schematically showing a two-side four-color printing apparatus, which is another example of the ink jet printing apparatus of the present invention.

FIGS. 7 to 9 each is a construction example of a one-side or two-side four-color printing apparatus. The principle of operation thereof and the like can be easily understood from the description above on the one-side monochromatic printing apparatus and therefore, these are omitted here.

In these figures, a construction example of a four-color printing apparatus is shown, however, the present invention is not limited thereto and the number of colors is freely selected according to the case.

FIGS. 10 and 11 each is a view for explaining another construction example of the printing apparatus according to the present invention, where an automatic discharge device 7 is provided and the printing medium is used by winding it around the opposing drum. FIG. 11 is a construction example of an apparatus having an automatic feed device 9 and using a sheet-like printing medium. The present invention is described here by referring to the construction example of an apparatus using a rolled printing medium of FIG. 10.

A printing medium is delivered by a printing medium feed roll 1, cut into an arbitrary size by a cutter 8 and then fixed on an opposing drum. At this time, the printing medium may be tightly fixed on the drum by a known mechanical method such as sheet head/edge gripping device or air suction device, or by an electrostatic method, whereby the sheet edge can be prevented from fluttering and contacting with the ink jet drawing device 3 to cause damages on drawing.

Also, means of closely contacting the printing medium with the drum only in the periphery of the drawing position of the ink jet drawing device may be disposed and actuated at least at the time of performing the drawing, whereby the printing medium can be prevented from contacting with the ink jet recording device. More specifically, for example, a method of disposing a presser roller upstream and downstream the drawing position of the opposing drum may be used.

The head is preferably separated from the printing medium during the time period of not performing the drawing, so that troubles such as damage due to contact can be effectively prevented from occurring on the ink jet drawing device.

The ejection head 22 which can be used is a single channel head, a multi-channel head or a full line head, and the main scanning is performed by the rotation of the opposing drum 4. In the case of a multi-channel head or full line head having a plurality of ejection parts, the head is disposed to array the ejection parts in the axial direction of the opposing drum 4.

In the case of a single channel head or a multi-channel head, the head 22 is continuously or sequentially moved in the axial direction of the opposing drum by the image data arithmetic and control part 21 and ejects an oil ink on the printing medium fixed to the drum 11 based on the ejection position and the halftone dot area factor obtained by the computation of the image data arithmetic and control part 21. By this ejection, a halftone image is drawn on the printing medium with the oil ink according to the variable density of the printing original. This operation continues until a predetermined oil ink image is formed on the printing medium.

On the other hand, in the case where the ejection head 22 is a full line head having almost the same length as the width of the drum, an oil ink image is formed on the printing medium to finish a printed matter by one rotation of the drum. As such, the main scanning is performed by the rotation of the drum, so that the positional precision in the main scanning direction can be elevated and high-speed drawing can be performed. The printing medium after the printing is fixed by a fixing apparatus 5 and then discharged by an automatic discharge device 7.

A construction example of a one-side four-color press is described here, however, the present invention is not limited thereto, and the number of colors, whether one-side printing or two-side printing, and the construction of the apparatus can be freely selected depending on the case.

FIGS. 12 and 13 each is a view showing a schematic construction example of a printing apparatus according to the present invention, where the drawing is performed by running a printing medium while interposing and holding it between capstan rollers. Out of these schematic construction examples, FIG. 12 is a view showing a printing apparatus using a rolled printing medium and FIG. 13 is a view showing a printing apparatus using a sheet-like printing medium.

The present invention is described below using an entire construction example of an apparatus for performing one-side four-color printing on a rolled printing medium shown in FIG. 12. A printing medium M interposed and held between two pairs of captain rollers 10 is delivered and using the data partitioned and computed into an appropriate number of picture elements and an appropriate number of gradations by the image data arithmetic and control part (21 of FIG. 14), an image is drawn by an ink jet drawing device 3. In the position where an image is drawn by the ink jet drawing device 3, earthing means 11 is preferably provided to work as a counter electrode of the ejection head electrode at the electrostatic ejection. By providing this means, the drawing is facilitated.

In FIG. 12, a sheet cutter 8 for cutting the rolled printing medium is provided upstream the automatic discharge device 7, however, the sheet cutter can be disposed at any appropriate position.

A process of preparing a printed matter using a printing apparatus of the present invention is described in greater detail below by referring to FIG. 12.

A printing medium is transported using capstan rollers 10. At this time, if desired, printing medium guide means (not shown) may be provided, whereby the head/edge of the printing medium can be prevented from fluttering and contacting with the ink jet drawing device 3 to cause damages. Furthermore, means of preventing loosening of the printing medium only in the periphery of the drawing position of the ink jet drawing device may be provided and by actuating this means at least at the time of performing the drawing, the printing medium can be prevented from contacting with the ink jet drawing device. To speak specifically, for example, a method of disposing a presser roller upstream and downstream the drawing position may be used.

The head is preferably separated from the printing medium during the time period of not performing the drawing, so that troubles such as damage due to contact can be effectively prevented from occurring on the ink jet drawing device.

The image data from a magnetic disc device or the like is sent to the image data arithmetic and control part 21 of FIG. 14 and according to the input image data, the image data arithmetic and control part 21 computes the position of ejecting an oil ink and the halftone dot area factor at that position. These computed data are once stored in a buffer.

The image data arithmetic and control part 21 controls the movement of ejection head 22, the timing of ejecting an oil ink and the action timing of capstan rollers and if necessary, approximates the ejection head 22 to the position proximate to the printing medium using a head-retreating or approximating device 31. The ejection head 22 and the surface of the printing medium are kept at a predetermined distance during the drawing using mechanical distance controlling means such as knock roller or by the control of the head-retreating or approximating device based on the signals from an optical distance detector. By this distance control, good printing can be performed without causing non-uniformity in the dot size due to floating of the printing medium or without causing any change in the dot size particularly when vibration is applied to the printing apparatus.

For the ejection head 22, a single channel head, a multi-channel head or a full line head may be used and the sub-scanning is performed by the transportation of the printing medium. In the case of a multi-channel head having a plurality of ejection parts, the head is disposed to array the ejection parts almost in parallel to the running direction of the printing medium. Furthermore, in the case of a single channel head or a multi-channel head, the head 22 is moved in the direction at a right angle to the running direction of the printing medium by the image data arithmetic and control part 21 and ejects an oil ink based on the ejection position and the halftone dot area factor obtained by the computation. By this ejection, a halftone image is drawn on the printing medium with the oil ink according to the variable density of the printing original. This operation continues until a predetermined oil ink image is formed on the printing medium. On the other hand, in the case where the ejection head 22 is a full line head having almost the same length as the width of the drum, the head is disposed to array the ejection parts almost at a right angle to the running direction of the printing medium and an oil ink image is formed on the printing medium by passing the printing medium through the drawing part. The printing medium after printing is fixed by a fixing apparatus 5 and then discharged by the automatic discharge device.

A construction example of a one-side four-color press is described here, however, the present invention is not limited thereto and the number of colors and whether one-side printing or two-side printing are freely selected according to the case.

The ink ejection drawing device 3 is described in detail below using FIG. 14.

As shown in FIG. 14, the drawing device for use in the ink jet printing process of the present invention comprises an ejection head 22 and an ink feed part 24.

The ink feed part 24 further has an ink tank 25, an ink feed device 26 and ink concentration-controlling means 29 and in the ink tank, stirring means 27 and ink temperature-controlling means 28 are contained. The ink may be circulated within the head and in this case, the ink feed part additionally has a recovery and circulating function. The stirring means 27 prevents the precipitation and coagulation of solid contents in the ink. For the stirring means, a rotary blade, an ultrasonic vibrator or a circulating pump may be used and one means may be selected therefrom or these means may be used in combination. The ink temperature-controlling means 28 is disposed so that the physical properties of ink or the dot size can be prevented from varying by the change in the ambient temperature and a high-quality image can be stably formed. For the ink temperature-controlling means, a known method may be used, for example, a method where a heat-generating element or a cooling element such as heater or Peltier device is disposed within the ink tank together with the stirring means and the temperature distribution within the tank is controlled constant by a temperature sensor such as thermostat. The ink temperature within the ink tank is preferably from 15 to 60° C., more preferably from 20 to 50° C. The stirring means of maintaining the temperature distribution constant within the tank may be common with the stirring means of preventing the precipitation or coagulation of solid components in ink. The drawing and printing device of the present invention has ink concentration-controlling means 29 for achieving high-quality drawing. The ink concentration is controlled by measuring the physical properties using, for example, optical detection, measurement of electrical conductivity or measurement of viscosity, or by counting the number of sheets subjected to the drawing. In the case of controlling the ink concentration by measuring the physical properties, an optical detector, an electrical conductivity-measuring meter and a viscosity-measuring meter are provided individually or in combination within the ink tank or on the ink passage and according to the output signal thereof, the feed to the ink tank from a concentrated ink tank (not shown) for replenishment or from a diluting ink carrier tank is controlled. In the case of controlling the ink concentration by counting the number of sheets subjected to the drawing, the feed is controlled by the number of sheets printed and the frequency of printing.

The image data arithmetic and control part 21, which computes the input image data as described above, takes in the timing pulse from an encoder 30 disposed in the head-retreating or approximating device 31, the opposing drum or the capstan roller and drives the head according to the timing pulse. At the time of performing the drawing by the ink jet recording device, the drawing drum is driven using high-precision driving means. To speak specifically, for example, a method of driving the drawing drum while decelerating the output from a high-precision motor using a high-precision gear or a steel belt may be used. By using these means individually or in combination, higher quality drawing can be attained.

The ink feed part 24 is described below.

Figure 5:
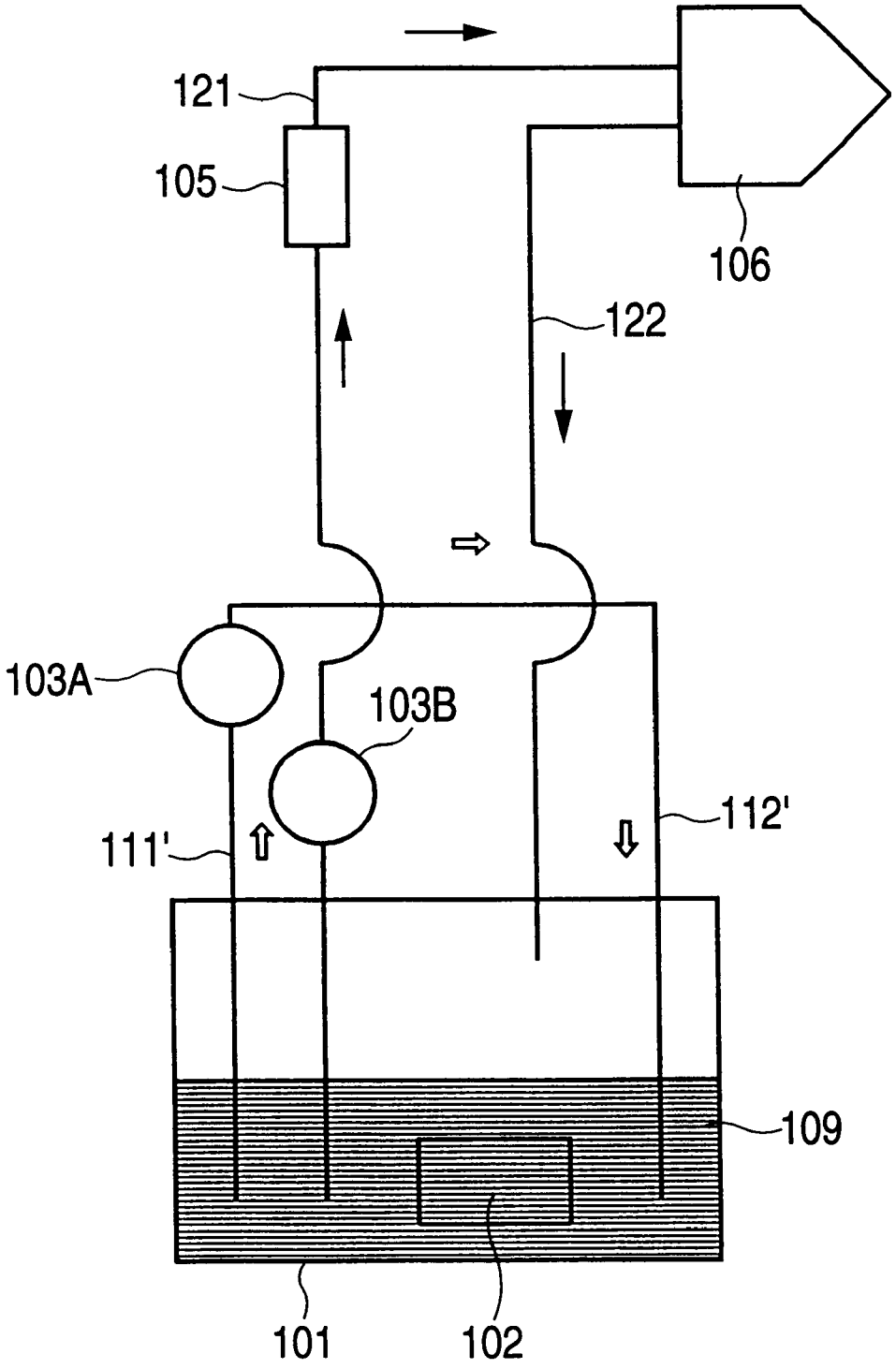
FIG. 5 is a view showing a conventional ink stirring device and a conventional liquid feed device.

In the ink jet method of ejecting an oil ink using electrostatic field, ink stirring means is conventionally provided within the ink tank for preventing the precipitation and coagulation of ink. As described above, a circulation pump, a stirring blade, an undulator or the like is used for the stirring means. In the case of a circulation pump, a pump for exclusive use of stirring is generally provided. On the other hand, a liquid feed pump for feeding an ink to the ejection head is also provided. Therefore, at least two pumps are provided. FIG. 5 shows an ink stirring device and a liquid feed device of this conventional type. In FIG. 5, 101 is an ink tank, 102 is ink temperature-controlling means, 103A is a circulation pump for stirring ink, 103 is a liquid feed pump for drawing, 105 is ink concentration-controlling means, 106 is an ejection head, 109 is an ink, 111' is a pipeline for circulation route (feed side), 112' is a pipeline for circulation route (return side), 121 is a pipeline for drawing route (feed side) and 122 is a pipeline for drawing route (return side).

As seen from this Figure, for the stirring of ink, a circulation route of ink tank 101→pipeline 111' for circulation route (feed side) 111'→circulation pump 103A for stirring ink→pipeline 112' for circulation route (return side) →ink tank 101 is constructed, where by operating the circulation pump 103A for stirring ink, the ink is circulated and stirred.

On the other hand, for the feed to the ejection head, a drawing route of ink tank 101→pipeline 121 for drawing route (feed side)→liquid feed pump 103B for drawing→ink concentration-controlling means 105→ejection head 106→pipeline 122 for drawing route→ink tank 101 is constructed, where the ink is fed to the ejection head 106 and the residual ink is recovered to the ink tank 101.

As such, in conventional apparatuses, at least two pumps of circulation pump 103A and liquid feed pump 103B are provided and this is one obstacle to the simplification, miniaturization and reduction in the cost of the apparatus as a whole.

According to the present invention, one large-volume pump is commonly used as the circulation pump 103A and the liquid feed pump 103B so as to attain simplification, miniaturization and reduction in the cost of the apparatus as a whole.

Figure 2:
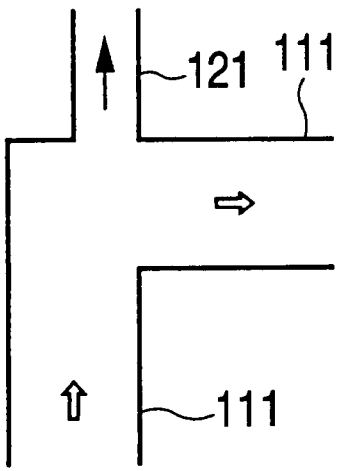
FIG. 2 is a view for explaining each shape of the branch point between a large aperture pipeline and a small aperture pipeline.
Figure 2:
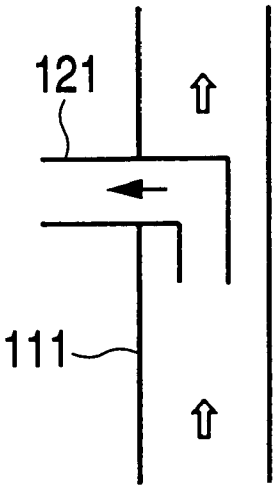
Figure 2:
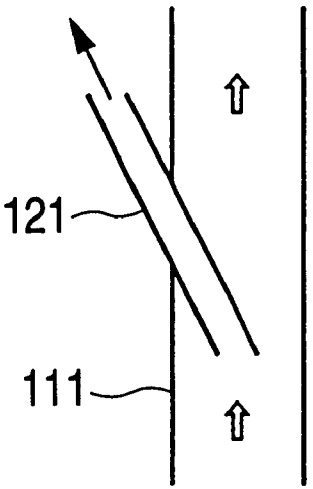

The first embodiment of the present invention is described by referring to FIG. 1 and FIG. 2.

In FIG. 1, 101 is an ink tank, 102 is ink temperature-controlling means, 103 is a large flow-rate circulation pump for use in the present invention, 104 is flow rate-controlling means in the feed side, 105 is ink concentration-controlling means, 106 is an ejection head, 109 is an ink, 111 is a large aperture pipeline for circulation route (feed side), 112 is a large aperture pipeline for circulation route (return side), 121 is a small aperture pipeline for drawing route (feed side) and 122 is a small aperture pipeline for drawing route (return side).

As seen from the Figure, the pipelines 111 and 112 for the ink circulation route each is a large aperture pipeline. One large aperture pipeline 111 for the ink circulation route, of which end is dipped in the ink 109 stored in the ink tank 101, passes through the circulation pump 113 provided on the way and is connected to another large aperture pipeline 112 for circulation route (return side). The other end of the large aperture pipeline 112 for circulation route (return side) returns to the ink tank 101.

On the other hand, the small aperture pipeline 121 for drawing route (feed side) is branched from the large aperture pipeline 111 for circulation route (feed side) and connected to the ejection head 106 through flow rate-controlling means 104 and ink concentration-controlling means 105 and returns to the ink tank 101 from the ejection head 106 through the small aperture pipeline 122 for drawing route (return side).

In this way, according to the present invention, one pump 103 is commonly used for the stirring function (ink tank 101→circulation routes 111, 112→ink tank 101) and the liquid feed function for drawing (ink tank 101→pipeline 121 for drawing route→flow rate-controlling means 104→ink concentration-controlling means 105→ejection head 106→pipeline 122 for drawing route→ink tank 101), so that simplification, miniaturization and reduction in the cost of the apparatus can be achieved.

The branch point between the large aperture pipeline and the small aperture pipeline preferably has a shape such that the opening of the small aperture pipeline viewed from the inside of the large aperture pipeline faces at least the liquid feed direction.

Specifically, the shape shown in FIG. 2 is preferred.

In each of FIGS. 2(*a*), (*b*) and (*c*), 111 is a large aperture pipeline for circulation route (feed side) and 121 is a small aperture pipeline for drawing route (feed side). FIG. 2(*a*) is a view showing a type where the end of the small aperture pipeline 121 for drawing route is connected to the pipe wall surface of the large aperture pipeline 111 for circulation route (feed side). This type can be easily and simply produced. FIGS. 2(*b*) and FIG. 2(*c*) are a type where the end of the small aperture pipeline 121 for drawing route is disposed in the center inside the large aperture pipeline 111 for circulation route (feed side). The former is a type where the small aperture line 121 for drawing route is piped at a right angle from the large aperture pipeline 111 for circulation route (feed side) and the latter is a type where the small aperture line 121 for drawing route is piped obliquely to the large aperture pipeline 111 for circulation route (feed side). In either type, the fluid energy loss can be reduced at the takeout port.

Figure 3:
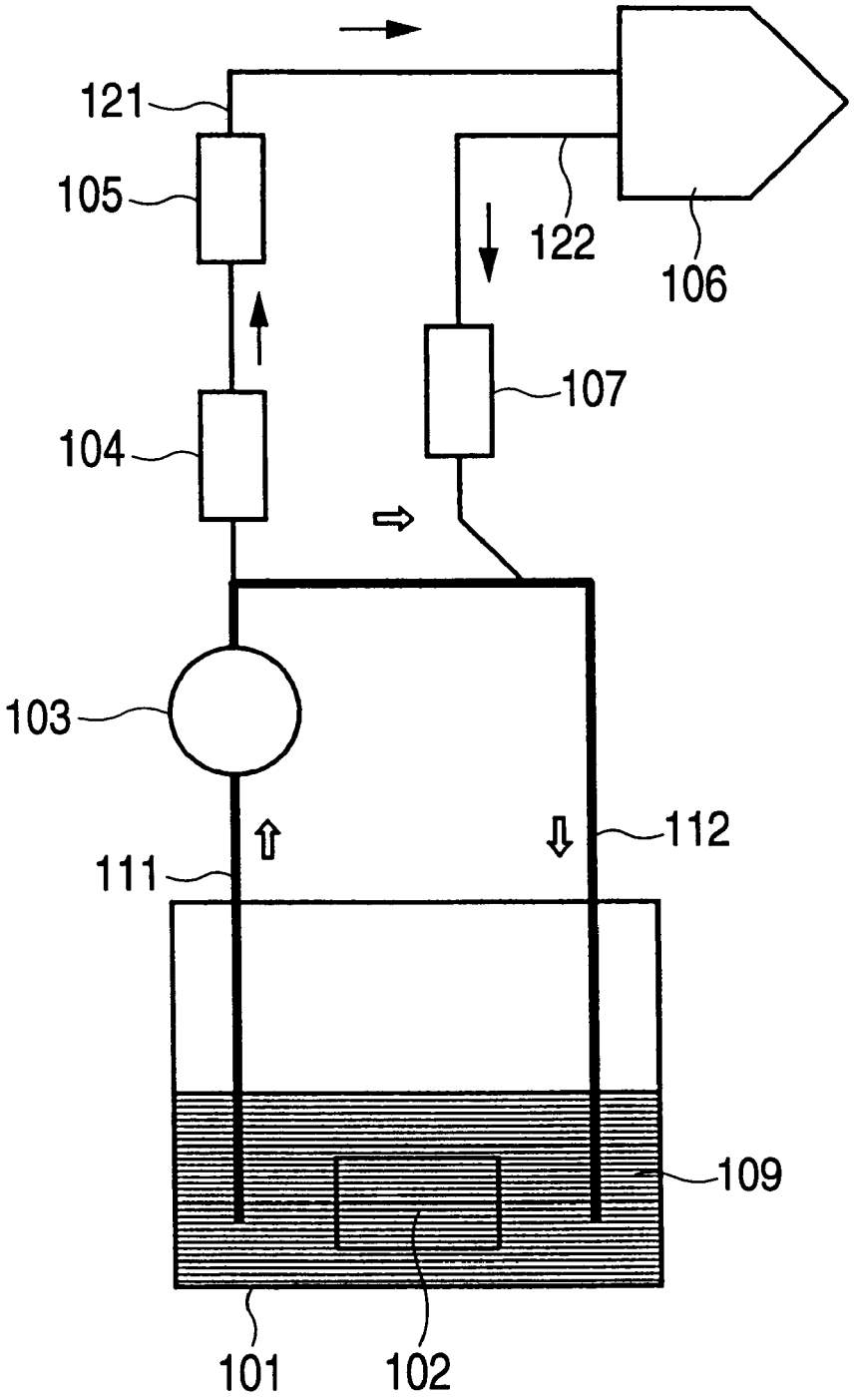
FIG. 3 is a view showing an ink stirring device and a liquid feed device according to the second embodiment of the present invention.
Figure 4:
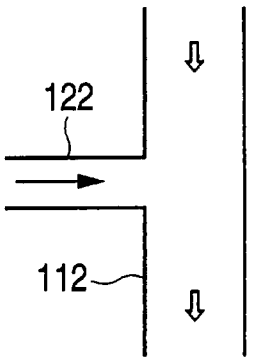
FIG. 4 is a view for explaining each shape of the confluent point between a large aperture pipeline and a small aperture pipeline.
Figure 4:
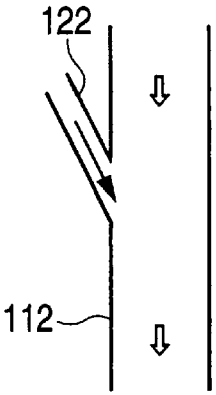
Figure 4:
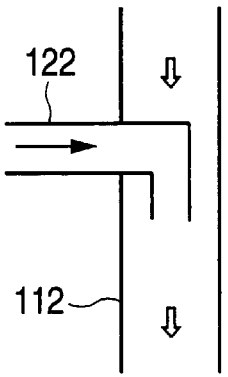
Figure 4:
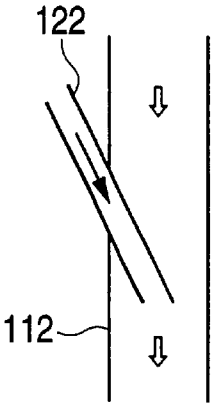

The second embodiment of the present invention is described using FIG. 3 and FIG. 4.

In FIG. 3, 101 is an ink tank, 102 is ink temperature-controlling means, 103 is a large flow-rate circulation pump for use in the present invention, 104 is flow rate-controlling means in the feed side, 105 is ink concentration-controlling means, 106 is an ejection head, 107 is flow rate-controlling means in the return side and 109 is an ink.

The numeral 111 is a large aperture pipeline for circulation route (feed side), 112 is a large aperture pipeline for circulation route (return side), 121 is a small aperture pipeline for drawing route (feed side) and 122 is a small aperture pipeline for drawing route (return side).

As seen from the Figure, the pipelines 111 and 112 for the ink circulation route each is a large aperture pipeline. One large aperture pipeline 111 for the ink circulation route, of which end is dipped in the ink 109 stored in the ink tank 101, passes through the circulation pump 113 provided on the way and is connected to another large aperture pipeline 112 for circulation route (return side). The other end of the large aperture pipeline 112 for circulation route (return side) returns to the ink tank 101.

On the other hand, the small aperture pipeline 121 for drawing route (feed side) is branched from the large aperture pipeline 111 for circulation route (feed side) and connected to the ejection head 106 through flow rate-controlling means 104 and ink concentration-controlling means 105 and the other end of the small aperture pipeline 122 for drawing route (return side) is connected to the large aperture pipeline 112 for circulation route (return side) through the flow rate-controlling means 107 in the return side provided on the way from the ejection head 106.

In this way, according to the present invention, one pump 103 is commonly used for the stirring function (ink tank 101→circulation routes 111, 112→ink tank 101) and the liquid feed function for drawing (ink tank 101→pipeline 121 for drawing route→flow rate-controlling means 104→ink concentration-controlling means 105→ejection head 106→pipeline 122 for drawing route→ink tank 101), so that simplification, miniaturization and reduction in the cost of the apparatus can be achieved. Furthermore, the small aperture pipeline in the return side from the ejection head is connected to the large aperture pipeline and at the same time, flow rate-controlling means is provided, so that more stable feed can be attained.

The connection point between the large aperture pipeline and the small aperture pipeline in the return side preferably has a shape such that the opening of the small aperture pipeline viewed from the inside of the large aperture pipeline does not face at least the feed direction of circulation route. Furthermore, the ejection direction from the return pipeline at the connection point preferably makes an angle of 0 to 90° from the feed direction of circulation route. Specifically, the shape shown in FIG. 4 is preferred.

In each of FIGS. 4(*a*), (*b*), (*c*) and (*d*), 112 is a large aperture pipeline for circulation route (return side) and 122 is a small aperture pipeline for drawing route (return side). FIGS. 4(*a*) and (*b*) are a type of piping right angled to the pipe wall surface of the large aperture pipeline for circulation route (return side) and the latter is a type of piping oblique thereto. In either type, the production is easy.

FIGS. 4(*c*) and (*d*) are a type where the end of the small aperture pipeline 122 for drawing route is disposed in the center inside the large aperture pipeline 112 for circulation route (return side). The former is a type of right angled piping and the latter is a type of oblique piping. In either type, the fluid energy loss can be reduced at the feed port.

The ejection head is described below using FIGS. 15 to 21, however, the present invention is not limited thereto.

Figure 15:
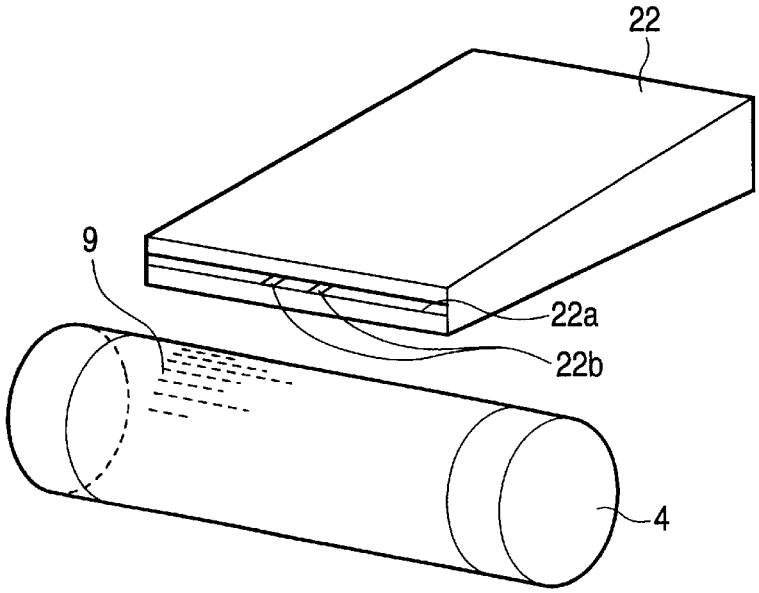
FIG. 15 is a view for explaining an ink jet recording device of the drawing device of FIG. 14.
Figure 16:
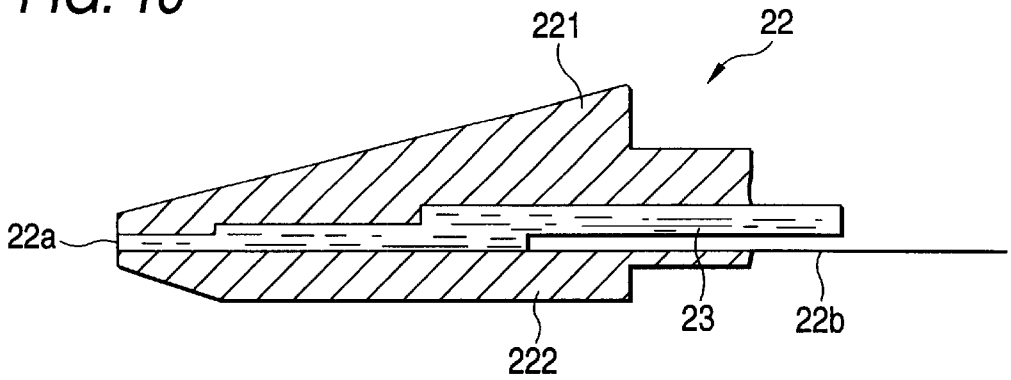
FIG. 16 is an enlarge cross-sectional view for explaining the ink jet recording device of FIG. 15.

FIGS. 15 and 16 each is a view showing one example of a head provided in the ink jet recording device. The head 22 has a slit sandwiched by an upper unit 221 and a lower unit 222 each comprising an insulating substrate, and the distal end of the slit works out to an ejection slit 22*a*. Within the slit, an ejection electrode 22*b* is disposed and the slit is filled with an ink 23 fed from the ink feed device. Examples of the insulating substrate which can be used include plastics, glass and ceramics. The ejection electrode 22*b* is formed by a known method, for example, a method of subjecting the lower unit 222 comprising an insulating substrate to vapor deposition, sputtering or electroless plating of an electrically conductive material such as aluminum, nickel, chromium, gold and platinum, coating a photoresist thereon, exposing the photoresist through a predetermined electrode pattern mask, developing it to form a photoresist pattern of the ejection electrode 22*b* and etching the pattern, a method of mechanically removing the photoresist pattern or a method comprising a combination thereof.

In the head 22, a voltage is applied to the ejection electrode 22*b* according to digital signals of the image pattern information. As shown in FIG. 15, a drawing drum which works out to a counter electrode is provided to face the ejection electrode 22*b* and on the drawing drum, a printing medium is provided. Upon application of a voltage, a circuit is formed between the ejection electrode 22*b* and the drawing drum as a counter electrode and an oil ink 23 is ejected from the ejection slit 22*a* of the head 22 to form an image on the printing medium provided on the drawing drum serving as a counter electrode.

With respect to the width of the ejection electrode 22*b*, the tip thereof is preferably as narrow as possible to form a high-quality image. The specific numerical value varies according to the conditions such as applied voltage and physical properties of ink but the tip width is usually from 5 to 100 $\mu$m.

For example, a dot of 40 $\mu$m can be formed on the printing medium 9 by using an ejection electrode 22*b* having tip in the width of 20 $\mu$m, providing a distance of 1.0 mm between the ejection electrode 22*b* and the drawing drum 4 as a counter electrode, and applying a voltage of 3 KV between these electrodes for 0.1 msec.

Figure 17:
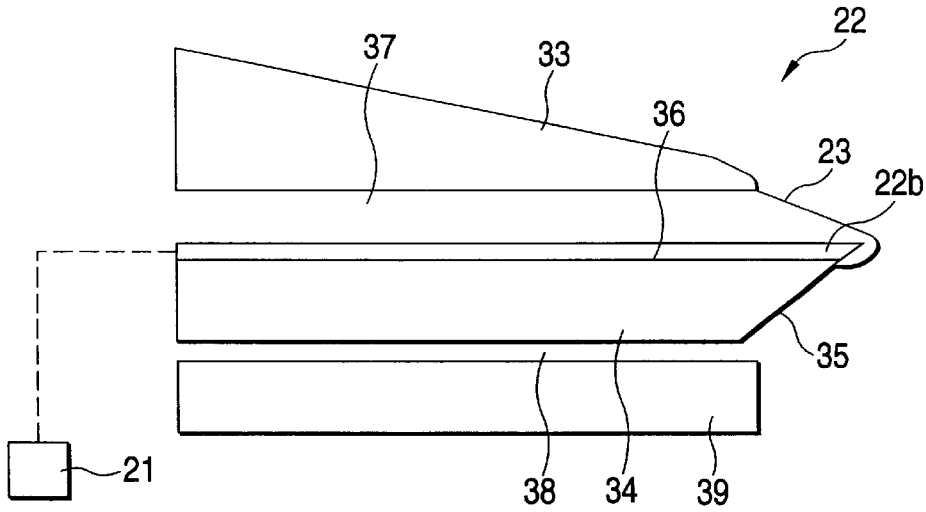
FIG. 17 is a schematic cross-sectional view showing the vicinity of the ink ejection part of the ejection head according to another example.
Figure 18:
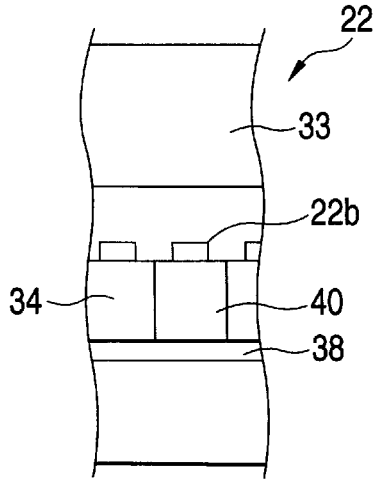
FIG. 18 is a schematic front view showing the vicinity of the ink ejection part of the ejection head according to another example.

FIGS. 17 and 18 are a schematic cross-sectional view and a schematic front view, respectively, showing the vicinity of the ink ejection part in another example of the ejection head. In the Figures, 22 is an ejection head and this ejection head 22 has a first insulating substrate 33 having a tapered shape. Opposing the first insulating substrate 33, a second insulating substrate 34 is provided with a clearance and at the distal end of the second insulating member 34, an inclined face part 35 is formed. The first and second insulating substrates each is formed of, for example, plastic, glass or ceramic. On the upper face part 36 making an acute angle with the inclined face part 35 of the second insulating substrate 34, a plurality of ejection electrodes 22*b* are provided as electrostatic field-forming means of forming an electrostatic field in the ejection part. Respective tips of these multiple ejection electrodes 22*b* are extended to the vicinity of the distal end of the upper face part 36 and the tips each is projected ahead of the first insulating substrate 33 and forms an ejection part. Between the first and second insulating substrates 33 and 34, an ink inflow passage 37 is formed as means of feeding an ink 23 to the ejection part and in the lower side of the second insulating substrate 34, an ink recovery passage 38 is formed. The ejection electrode 22*b* is formed on the second insulating substrate 34 in the same manner as above by a known method using an electrically conducting material such as aluminum, nickel, chromium, gold and platinum. The individual electrodes 22*b* are constructed to lie in the electrically insulating state from each other. The tip of the ejection electrode 22*b* is preferably projected to the length of 2 mm or less from the distal end of the insulating substrate 33. The projection length is preferably within this range because if the projection length is excessively large, the ink meniscus does not reach the distal end of the ejection part to cause difficulty in the ejection or reduction in the recording frequency. The space between the first and second insulating substrates 33 and 34 is preferably from 0.1 to 3 mm. The space is preferably within this range because if the space is too small, the feed of ink and in turn, the ejection of ink become difficult or the recording frequency decreases, whereas if the space is excessively large, the meniscus is not stabilized and unstable ejection results. The ejection electrode 22*b* is connected to the image data arithmetic and control part 21 and in performing the recording, a voltage is applied to the ejection electrode based on the image information, the ink on the ejection electrode is ejected and an image is drawn on a printing medium (not shown) disposed to face the ejection part. In the direction reverse to the ink droplet-ejecting direction of the ink inflow passage 37, ink feed means of the ink feed device is connected. On the surface opposite the ejection electrode-formed surface of the second insulating substrate 34, a backing 39 is provided with a clearance. Between these, an ink recovery passage 38 is provided. The ink recovery passage 38 preferably has a space of 0.1 mm or more. The space is limited to this range because if the space is too small, the ink cannot be easily recovered and ink leakage may occur. To the ink recovery passage 38, ink recovery means of the ink feed device (not shown) is connected. In the case where a uniform ink flow is necessary on the ejection part, a groove 40 may be provided between the ejection part and the ink recovery passage. FIG. 18 is a schematic front view showing the vicinity of the ink ejection part of the ejection head. On the inclined face of the second insulating substrate 34, a plurality of grooves 40 are provided to extend from the vicinity of the boundary with the ejection electrode 22*b* toward the ink recovery passage 38. These grooves 40 in plurality are aligned in the array direction of the ejection electrodes 22*b* and each has a function of introducing a constant amount of ink in the vicinity of the tip of the ejection electrode through the opening in the ejection electrode 22*b* side by a capillary force according to the opening diameter and discharging the introduced ink to the ink recovery passage 38. Therefore, the groove has a function of forming an ink flow having a constant liquid thickness in the vicinity of the ejection electrode tip. The shape of the groove 40 may be sufficient if a capillary force can work, but the width is preferably from 10 to 200 $\mu$m and the depth is preferably from 10 to 300 $\mu$m. The grooves 40 are provided in the number necessary for forming a uniform ink flow throughout the head.

With respect to the width of the ejection electrode 22*b*, the tip of the ejection electrode is preferably as narrow as possible for forming a high-quality image. The specific numerical value varies depending on the applied voltage, physical properties of ink or the like, however, the tip width is usually from 5 to 100 $\mu$m.

Figure 19:
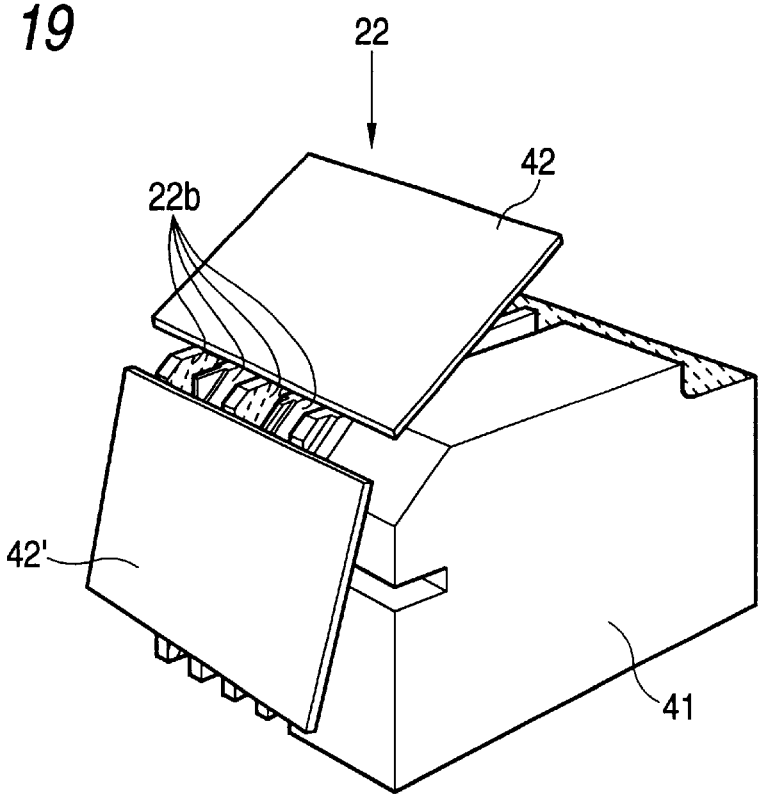
FIG. 19 is a schematic view showing only one part of the ejection head according to another example.
Figure 20:
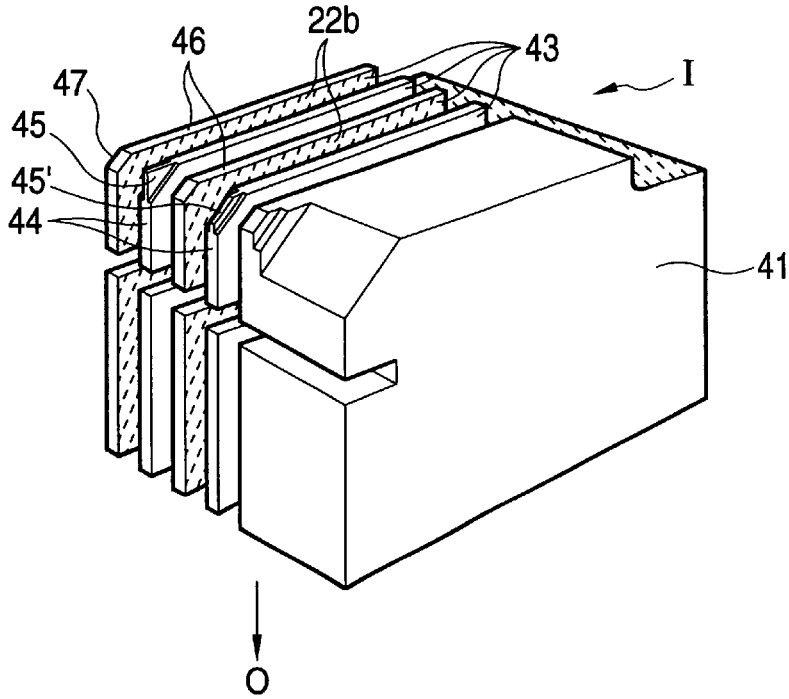
FIG. 20 is a schematic view of the ejection head of FIG. 19 from which regulating plates 42 and 42' are removed.

FIGS. 19 and 20 each is a view showing another example of the ejection head used in practicing the present invention. FIG. 19 is a schematic view showing only a part of the head for the purpose of explanation. As shown in FIG. 19, the recording head 22 comprises a head body 41 formed of an insulating material such as plastic, ceramic or glass, and meniscus regulating plates 42 and 42'. In the Figures, 22*b* is an ejection electrode for applying a voltage and thereby forming an electrostatic field in the ejection part. The head body is described in detail below by referring to FIG. 20 showing the head from which the meniscus regulating plates 42 and 42' are removed. In the head body 41, a plurality of ink grooves 43 for circulating the ink are provided perpendicularly to the edge of the head body. The shape of the ink groove 43 may be sufficient if a capillary force can work to form a uniform ink flow, but the width is preferably from 10 to 200 $\mu$m and the depth is preferably from 10 to 300 $\mu$m. Inside the ink groove 43, an ejection electrode 22*b* is provided. This ejection electrode 22*b* may be provided throughout or only on a part of the inner surface of the ink groove 43 on the head body 40 comprising an insulating material, using an electrically conducting material such as aluminum, nickel, chromium, gold and platinum by a known method similarly to the case of apparatus described above. The ejection electrodes are electrically isolated from each other. One cell is formed by two adjacent ink grooves and in the center thereof, a partition 44 is disposed. At the distal end of the partition, ejection parts 45 and 45' are provided. The partition is reduced in the thickness and sharpened at the ejection parts 45 and 45' as compared with other partition parts 44. Such a head body is manufactured using an insulating material block by a known method such as mechanical working, etching or molding. The thickness of the partition at the ejection part is preferably from 5 to 100 $\mu$m and the radius of curvature at the sharpened tip is preferably from 5 to 50 $\mu$m. The ejection part may be slightly chamfered as shown by 45'. In the Figures where only two cells are shown, the cells are divided by a partition 46 and the distal end 47 thereof is chambered to recede than the ejection parts 45 and 45'. Into this head, an ink is flown through the ink groove from the I direction by the ink feed means of the ink feed device (not shown) and fed to the ejection part. The excess ink is recovered toward the O direction by ink recovery means (not shown), whereby a fresh ink is always fed to the ejection part. In this state, a voltage is applied to the ejection electrodes according to the image information, as a result, an ink is ejected from the ejection part to the drawing drum (opposing drum) (not shown) provided to face the ejection part and having abutted to the surface thereof a printing medium and thereby, an image is formed on the printing medium.

Figure 21:
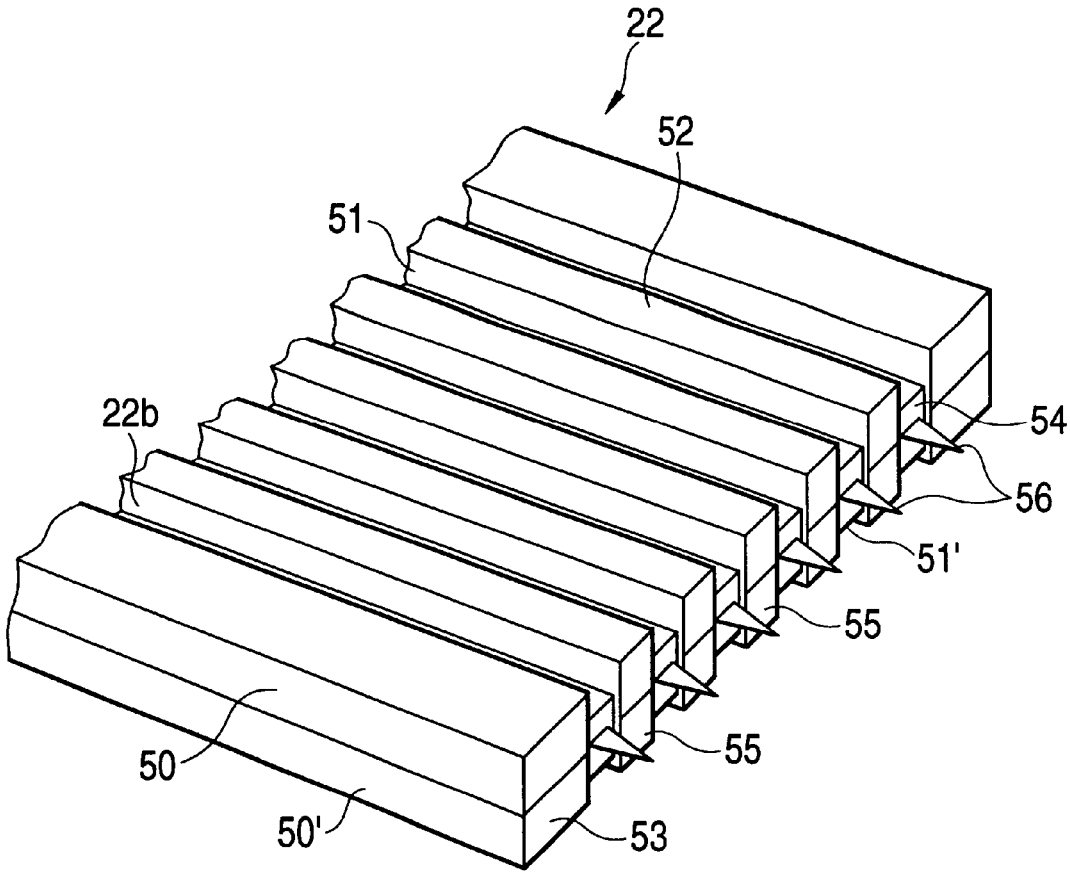
FIG. 21 is a schematic view showing only one part of the ejection head using 4 sets of 100 dpi multi-channel head with 256 channels.

Another example of the ejection head is described below using FIG. 21. As shown in FIG. 21, the ejection head 22 has a pair of support members 50 and 50' nearly in the rectangular shape. These support members 50 and 50' are formed of a plate-like material having an insulating property, such as plastic, glass or ceramic, and having a thickness of 1 to 10 mm. On one surface of each support member, a plurality of rectangular grooves 51, 51' extending in parallel to each other are formed according to the recording resolution. Each groove 51, 51' preferably has a width of 10 to 200 $\mu$m and a depth of 10 to 300 $\mu$m. Throughout or on a part of the inside thereof, an ejection electrode 22*b* is formed. By forming a plurality of grooves 51, 51' on one surface of each support member 50, 50' as such, a plurality of rectangular partitions 52 are necessarily provided between respective grooves 51. The support members 50 and 50' are combined such that the surfaces having not provided thereon the grooves 51, 51' face each other. That is, the ejection head 22 has a plurality of grooves for passing an ink on the outer circumferential surface thereof. The grooves 51 and 51' formed on respective support members 50 and 50' are connected through the rectangular part 54 of the ejection head 22 to correspond one by one. The rectangular part 54 resultant from respective grooves being connected is retreated by a predetermined distance (from 50 to 500 $\mu$m) from the upper end 53 of the ejection head 22. In other words, the upper end 55 of each partition 52 in both sides of each rectangular part 54 of respective support members 50 and 50' projects from the rectangular part 54. On each rectangular part 54, a guide projection 56 comprising an insulating material described above is provided to project therefrom and form an ejection part. In the case of circulating an ink to the thus-constructed ejection head 22, an ink is fed to each rectangular part 54 through each groove 51 formed on the outer circumferential surface of one support member 50 and discharged through each groove 51' formed on the support member 50' in the opposite side. In this case, the ejection head 22 is inclined at a predetermined angle so as to enable smooth flow of the ink. That is, the ejection head 22 is inclined such that the ink feed side (support member 50) is positioned upward and the ink discharge side (support member 50') is positioned downward. When an ink is circulated to the ejection head 22, the ink passing through each rectangular part 54 comes to full wetting along each projection 56 and an ink meniscus is formed in the vicinity of the rectangular part 54 and the projection 56. In this state where ink meniscuses are formed independently from each other on respective rectangular parts 54, a voltage is applied to the ejection electrode 22*b* based on the image information, as a result, an ink is ejected from the ejection part to the drawing drum (not shown) provided to face the ejection part and having abutted to the surface thereof a printing medium and thereby, an image is formed on the printing medium. Here, a cover for covering the grooves may be provided on the outer circumferential surface of each support member 50, 50' to form a piped ink passage on the outer circumferential surface of each support member 50, 50' and thereby forcedly circulate an ink through this ink passage. In this case, the ejection head 22 needs not be inclined.

The ejection head 22 shown in FIGS. 15 to 21 may contain a maintenance device such as head cleaning means, if desired. For example, in the case where the dormant state continues or where a trouble is generated in the image quality, means of wiping the ejection head tip with a material having flexibility, such as scrub, brush or cloth, means of circulating only an ink solvent, means of feeding only an ink solvent, and means of sucking the ejection part while circulating the ink solvent may be used. By using these means individually or in combination, good drawing state can be maintained. For preventing the solidification of ink, a method of placing the ejection head within a cover filled with an ink solvent vapor or a method of cooling the head part to suppress the evaporation of ink solvent is effective. In the case where the contamination is more sticking, a method of enforcedly sucking the ink from the ejection part, a method of enforcedly jetting an air, ink or ink solvent from the ink passage, a method of applying an ultrasonic wave while dipping the head in an ink solvent, or the like is effective. These methods may be used individually or in combination.

The printing medium for use in the present invention is described below.

Examples of the printing medium include printing paper sheets commonly used, such as wood-free paper, fine coated paper and coated paper. In addition, paper sheets having thereon a resin film layer, such as polyolefin laminated paper, and plastic films such as polyester film, polystyrene film, vinyl chloride film and polyolefin film, may also be used. Furthermore, plastic film or processed paper on the surface of which a metal is deposited or a metal foil is laminated may be used. Needless to say, paper and film exclusive for ink jet printing can be used.

The oil ink for use in the present invention is described below.

The oil ink for use in the present invention is obtained by dispersing at least colored particles in a nonaqueous solvent having an electric resistivity of $10^9$ Ωcm or more and a dielectric constant of 3.5 or less.

The nonaqueous solvent having an electric resistivity of $10^9$ Ωcm or more and a dielectric constant of 3.5 or less for use in the present invention is preferably a linear or branched aliphatic hydrocarbon, alicyclic hydrocarbon or aromatic hydrocarbon or a halogen substitution product of these hydrocarbons. Examples thereof include hexane, heptane, octane, isooctane, decane, isodecane, decalin, nonane, dodecane, isododecane, cyclohexane, cyclooctane, cyclodecane, benzene, toluene, xylene, mesitylene, Isoper C, Isoper E, Isoper G, Isoper H, Isoper L (Isoper: a trade name of Exxon Corp.), Shellsol 70, Shellsol 71 (Shellsol: a trade name of Shell Oil Corp.), Amsco OMS solvent, Amsco 460 solvent (Amsco: a trade name of American Mineral Spirits Co.), and silicone oil. These are used individually or in combination. The upper limit of the electric resistivity of the nonaqueous solvent is about $10^{16}$ Ωcm and the lower limit of the dielectric constant is about 1.9.

The electric resistance of the nonaqueous solvent is specified to the above-described range because if the electric resistance is less than this range, colored particles or the like are not easily concentrated, the dots formed are colored thinly or bleeding is generated. The dielectric constant is specified to the above-described range because if the dielectric constant exceeds this range, the electric field is relaxed due to polarization of the solvent and thereby, the ink is poorly ejected.

In dispersing colored particles in the nonaqueous solvent, a coloring material itself may be dispersed as disperse particles in a nonaqueous solvent or may be incorporated into a disperse resin particle for improving the fixing property. In the case of incorporating the coloring material, a method of covering the coloring material with a resin material of the disperse resin particle to form a resin-coated particle is generally used for a pigment and a method of coloring the disperse resin particle to form a colored particle is generally used for a dye.

The coloring material may be any insofar as it is a pigment or a dye conventionally used for oil ink compositions or liquid developers for electrostatic photography.

With respect to the pigment, those commonly used in the technical field of printing may be used irrespective of an inorganic pigment or an organic pigment. Specific examples thereof include known pigments such as carbon black, cadmium red, molybdenum red, Chrome Yellow, cadmium yellow, titanium yellow, chromium oxide, viridian, cobalt green, ultramarine blue, Prussian blue, cobalt blue, azo-type pigments, phthalocyanine-type pigments, quinacridone-type pigments, isoindolinone-type pigments, dioxazine-type pigments, threne-type pigments, perylene-type pigments, perinone-type pigments, thioindigo-type pigments, quinophthalone-type pigments and metal complex pigments. These can be used without any particular limitation.

The dye is preferably an oil-soluble dye such as azo dye, metal complex salt dye, naphthol dye, anthraquinone dye, indigo dye, carbonium dye, quinoneimine dye, xanthene dye, aniline dye, quinoline dye, nitro dye, nitroso dye, benzoquinone dye, naphthoquinone dye, phthalocyanine dye and metallo-phthalocyanine dye.

These pigments and dyes may be used individually or in an appropriate combination. The coloring material is preferably contained in an amount of 0.5 to 5 wt % based on the entire ink.

In the oil ink for use in the present invention, a disperse resin particle for improving the fixing property of the image after printing is preferably contained together with the colored particle.

The resin particle dispersed in the nonaqueous solvent may be sufficient if it is a hydrophobic resin particle which is solid at a temperature of 35° C. or less and has high affinity for the nonaqueous solvent. However, the resin particle is preferably a resin (P) having a glass transition point of −5 to 110° C. or a softening point of 33 to 140° C., more preferably having a glass transition point of 10 to 100° C. or a softening point of 38 to 120° C., still more preferably having a glass transition point of 15 to 80° C. or a softening point of 38 to 100° C.

By using a resin having such a glass transition point or softening point, the affinity between the surface of the printing medium and the resin particle increases and the bonding among resin particles is intensified on the printing medium, so that the adhesion between the image area and the surface of the printing medium can be improved and the rubbing resistance can also be improved. If the glass transition point or softening point is lower or higher than the above-described range, the affinity between the surface of the printing medium and the resin particle or the bonding force among resin particles decrease.

The weight average molecular weight (Mw) of the resin (P) is from $1\times10^3$ to $1\times10^6$, preferably from $5\times10^3$ to $8\times10^5$, more preferably from $1\times10^4$ to $5\times10^5$.

Specific examples of the resin (P) include olefin polymers and copolymers (for example, polyethylene, polypropylene, polyisobutylene, ethylene-vinyl acetate copolymer, ethylene-acrylate copolymer, ethylene-methacrylate copolymer and ethylene-methacrylic acid copolymer), vinyl chloride polymers and copolymers (for example, polyvinyl chloride and vinyl chloride-vinyl acetate copolymer), vinylidene chloride copolymers, vinyl alkanoate polymers and copolymers, allyl alkanoate polymers and copolymers, polymers and copolymers of styrene and derivatives thereof (for example, butadiene-styrene copolymer, isoprene-styrene copolymer, styrene-methacrylate copolymer and styrene-acrylate copolymer), acrylonitrile copolymers, methacrylonitrile copolymers, alkyl vinyl ether copolymers, acrylic acid ester polymers and copolymers, methacrylic acid ester polymers and copolymers, itaconic acid diester polymers and copolymers, maleic anhydride copolymers, acrylamide copolymers, methacrylamide copolymers, phenolic resins, alkyd resins, polycarbonate resins, ketone resins, polyester resins, silicon resins, amide resins, hydroxyl group- or carboxyl group-modified polyester resins, butyral resins, polyvinyl acetal resins, urethane resins, rosin-based resins, hydrogenated rosin resins, petroleum resins, hydrogenated petroleum resins, maleic acid resins, terpene resins, hydrogenated terpene resins, chroman-indene resins, cyclic rubber-methacrylic acid ester copolymers, cyclic rubber-acrylic acid ester copolymers, copolymers containing a heterocyclic ring having no nitrogen atom (examples of the heterocyclic ring include furan ring, tetrahydrofuran ring, thiophene ring, dioxane ring, dioxofuran ring, lactone ring, benzofuran ring, benzothiophene ring and 1,3-dioxetane ring), and epoxy resins.

In the oil ink for use in the present invention, the total content of colored particles and resin particles dispersed is preferably from 0.5 to 20 wt % based on the entire ink. If the content is less than this range, problems are liable to arise, for example, the printing image density is deficient or the ink can hardly have affinity for the surface of the printing medium to fail in obtaining a firm image. On the other hand, if the content exceeds the above-described range, uniform dispersion may not be easily obtained or non-uniform ink flow readily occurs in the ejection head to fail in attaining stable ink ejection.

The particles dispersed in the nonaqueous solvent for use in the present invention, including the colored particles and further resin particles, preferably have an average particle size of 0.05 to 5 $\mu$m, more preferably from 0.1 to 1.5 $\mu$m, still more preferably from 0.4 to 1.0 $\mu$m. This particle size is determined by CAPA-500 (trade name, manufactured by Horiba Seisakusho Co., Ltd.).

The nonaqueous disperse colored particle for use in the present invention may be produced by a conventionally known mechanical grinding method or polymerization-granulating method. Examples of the mechanical grinding method include a method where after mixing a coloring material and a resin, if desired, these are melted, kneaded and directly ground into fine particles by a conventionally known grinder and the fine particles are dispersed using a dispersion polymer in combination by a wet dispersing machine (for example, ball mill, paint shaker, Kedy mill and Dyno mill), and a method where a coloring material as a colored particle component and a dispersion aid polymer (or a covering polymer) are previously kneaded and the kneaded product is ground and then dispersed in the presence of a dispersion polymer. Specifically, a production process of coating materials or liquid developers for electrostatic photography may be used and this is described, for example, in Kenji Ueki (supervisor of translation), *Toryo no Ryudo to Ganryo Bunsan* (*Flow of Coating Materials and Dispersion of Pigments*), Kyoritsu Shuppan (1971), Solomon, *Toryo no Kagaku* (*Science of Coatings*), Hirokawa Shoten (1969), Yuji Harasaki, *Coating Kogaku* (*Coating Engineering*), Asakura Shoten (1971), and Yuji Harasaki, *Coating no Kiso Kagaku* (*Elemental Coating Science*), Maki Shoten (1977).

A method of granulating resin particles by a polymerization-granulating method and coloring the resin particles with a dye to produce colored particles may also be used. Examples of the polymerization-granulating method include a conventionally known nonaqueous dispersion polymerization method and this is specifically described, for example, in Soichi Muroi (supervisor of compilation), *Cho-Biryushi Polymer no Saishin Gijutsu* (*Latest Technology of Ultrafine Polymers*), Chapter 2, CMC Shuppan (1991), Koichi Nakamura (compiler), *Saikin no Denshi-Shasin Genzo System to Toner Zairyo no Kaihatsu/Jitsuyoka* (*Recent Electrophotographic Developing Systems and Development and Practical Use of Toner Materials*), Chapter 3, Nippon Kagaku Joho K. K. (1985), and K. E. J. Barrett, *Dispersion Polymerization in Organic Media*, John Wiley (1975).

In order to dispersion-stabilizing the dispersed particles in the nonaqueous solvent, a dispersion polymer is usually used in combination. The dispersion polymer mainly comprises a repeating unit soluble in the nonaqueous solvent and preferably has a weight average molecular weight (Mw) of $1\times10^3$ to $1\times10^6$, more preferably from $5\times10^3$ to $5\times10^5$.

The preferred soluble repeating unit of the dispersion polymer for use in the present invention includes a polymerization component represented by the following formula (I):

Formula (I)

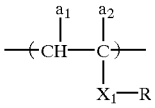

In formula (I), $X_1$ represents —COO—, —OCO— or —O—.

R represents an alkyl or alkenyl group having from 10 to 32 carbon atoms, preferably an alkyl or alkenyl group having from 10 to 22 carbon atoms, which may be either linear or branched. The alkyl or alkenyl group is preferably unsubstituted but may have a substituent.

Specific examples thereof include a decyl group, a dodecyl group, a tridecyl group, a tetradecyl group, a hexadecyl group, an octadecyl group, an eicosanyl group, a docosanyl group, a decenyl group, a dodecenyl group, a tridecenyl group, a hexadecenyl group, an octadecenyl group and a linoleyl group.

$a_1$ and $a_2$, which may be the same or different, each represents a hydrogen atom, a halogen atom (e.g., chlorine, bromine), a cyano group, an alkyl group having from 1 to 3 carbon atoms (e.g., methyl, ethyl, propyl), —COO—$Z_1$ or —$CH_2$COO—$Z_1$ (wherein $Z_1$ represents a hydrocarbon group having 22 or less carbon atoms, which may be substituted, such as alkyl group, alkenyl group, aralkyl group, alicyclic group and aryl group.

Among the hydrocarbon groups represented by $Z_1$, preferred hydrocarbon groups are an alkyl group having from 1 to 22 carbon atoms, which may be substituted, such as methyl group, ethyl group, propyl group, butyl group, hexyl group, heptyl group, octyl group, nonyl group, decyl group, dodecyl group, tridecyl group, tetradecyl group, hexadecyl group, octadecyl group, eicosanyl group, docosanyl group, 2-chloroethyl group, 2-bromoethyl group, 2-cyanoethyl group, 2-methoxycarbonylethyl group, 2-methoxyethyl group and 3-bromopropyl group; an alkenyl group having from 4 to 18 carbon atoms, which may be substituted, such as 2-methyl-1-propenyl group, 2-butenyl group, 2-pentenyl group, 3-methyl-2-pentenyl group, 1-pentenyl group, 1-hexenyl group, 2-hexenyl group, 4-methyl-2-hexenyl group, decenyl group, dodecenyl group, tridecenyl group, hexadecenyl group, octadecenyl group and linolenyl group; an aralkyl group having from 7 to 12 carbon atoms, which may be substituted, such as benzyl group, phenethyl group, 3-phenylpropyl group, naphthylmethyl group, 2-naphthylethyl group, chlorobenzyl group, bromobenzyl group, methylbenzyl group, ethylbenzyl group, methoxybenzyl group, dimethylbenzyl group and dimethoxybenzyl group; an alicyclic group having from 5 to 8 carbon atoms, which may be substituted, such as cyclohexyl group, 2-cyclohexylethyl group and 2-cyclopentylethyl group; and an aromatic group having from 6 to 12 carbon atoms, which may be substituted, such as phenyl group, naphthyl group, tolyl group, xylyl group, propylphenyl group, butylphenyl group, octylphenyl group, dodecylphenyl group, methoxyphenyl group, ethoxyphenyl group, butoxyphenyl group, decyloxyphenyl group, chlorophenyl group, dichlorophenyl group, bromophenyl group, cyanophenyl group, acetylphenyl group, methoxycarbonylphenyl group, ethoxycarbonylphenyl group, butoxycarbonylphenyl group, acetamidophenyl group, propionamidophenyl group and dodecyloylamidophenyl group.

The dispersion polymer may contain another repeating unit as a copolymerization component together with the repeating unit represented by formula (I). The another copolymerization component may be any compound insofar as it comprises a monomer copolymerizable with the monomer corresponding to the repeating unit represented by formula (I).

The proportion of the polymer component represented by formula (I) present in the dispersion polymer is preferably 50 wt % or more, more preferably 60 wt % or more.

Specific examples of the dispersion polymer include Resin (Q-1) for dispersion stabilization used in Examples. Also, commercially available products (for example, Solprene 1205, produced by Asahi Chemical Industry Co., Ltd.) may be used.

In the case of producing the particles of Resin (P) as a dispersion (latex) or the like, the dispersion polymer is preferably added in advance of the polymerization.

The amount of the dispersion polymer added is approximately from 1 to 50 wt % based on Resin (P) for particles.

The colored particle (or coloring material particle) and the disperse resin particle in the oil ink for use in the present invention each is preferably an electroscopic particle bearing positive or negative charge.

For imparting electroscopicity to these particles, this may be achieved by appropriately using a technique of developers for wet electrostatic photography. To speak specifically, the electroscopicity is imparted using an electroscopic material such as charge controlling agent and other additives described, for example, in *Saikin no Denshi-Shasin Genzo System to Toner Zairyo no Kaihatsu/Jitsuyoka* (*Recent Electrophotographic Developing Systems and Development and Practical Use of Toner Materials*), supra, pp. 139–148, *Denshi Shashin Gijutsu no Kiso to Oyo* (*Elementary Study and Application of Electrophotographic Technology*), Denshi Shashin Gakkai (compiler), pp. 497–505, Corona Sha (1988), and Yuji Harasaki, *Denshi Shashin* (*Electrophotography*), 16 (No. 2), page 44 (1977).

This is more specifically described, for example, in British Patents 893,429, 934,038 and 1,122,397, U.S. Pat. Nos. 3,900,412 and 4,606,989, JP-A-60-179751, JP-A-60-185963 and JP-A-2-13965.

The charge controlling agent is preferably added in an amount of 0.001 to 1.0 part by weight per 1,000 parts by weight of the dispersion medium as a carrier liquid. If desired, various additives may be further added and the upper limit of the total amount of these additives is determined by the electric resistance of the oil ink. More specifically, if the electric resistance of the ink in the state where dispersed particles are removed is less than $10^9$ Ωcm, an image having good continuous gradation may not be obtained. Therefore, the amount of each additives is preferably controlled within this limit.

EXAMPLE

The present invention is described in greater detail below by referring to the Examples, however, the present invention should not be construed as being limited thereto.

A production example of Resin Particle (PL-1) for ink is described below.

Production Example 1

Production of Resin Particle (PL-1):

A mixed solution containing 10 g of Resin (Q-1) for dispersion stabilization having a structure shown below, 100 g of vinyl acetate and 384 g of Isoper H was heated to a temperature of 70° C. while stirring in a nitrogen stream. Thereto, 0.8 g of 2,2'-azobis(isovaleronitrile) (hereinafter simply referred to as "A.I.V.N.") was added as a polymerization initiator and the reaction was performed for 3 hours. 20 Minutes after the addition of the initiator, the solution turned to milky white and the reaction temperature elevated to 88° C. Thereto, 0.5 g of the same initiator was further added and the reaction was performed for 2 hours. Thereafter, the temperature was elevated to 100° C., the reaction solution was stirred for 2 hours, and unreacted vinyl acetate was removed by distillation. The residue was cooled and passed through a 200-mesh nylon cloth. The white dispersion obtained was a latex having a polymerization degree of 90%, an average particle size of 0.23 μm and good monodispersity. The particle size was measured by CAPA-500 (manufactured by Horiba Seisakusho K.K.).

Resin (Q-1) for Dispersion Stabilization:

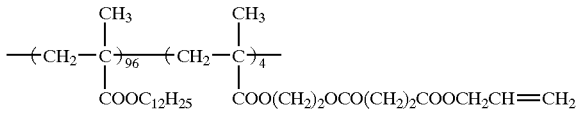

(by weight)

Mw: $5\times10^4$

A part of the thus-obtained white dispersion was centrifuged (number of revolution: $1\times10^4$ rpm, rotation time: 60 minutes) and the precipitated resin particle portion was collected and dried. The resin particle portion had a weight average molecular weight (Mw, GPC value in terms of polystyrene) of $2\times10^5$ and a glass transition point (Tg) of 38° C.

Example 1

An oil ink was prepared.

<Preparation of Oil ink (IK-1)>

Into a paint shaker (manufactured by Toyo Seiki K.K.), 10 g of dodecyl methacrylate/acrylic acid copolymer (copolymerization ratio: 95/5 by weight), 10 g of nigrosine and 30 g of Shellsol 71 were charged together with glass beads and dispersed for 4 hours to obtain a fine nigrosine dispersion.

Then, 30 g (as solid contents) of Resin Particle (PL-1) produced in Preparation Example 1 of Resin Particle for Ink, 20 g of the nigrosine dispersion prepared above, 15 g of FOC-1400 (tetradecyl alcohol, produced by Nissan Chemical Industries Co., Ltd.) and 0.08 g of an octadecene-half maleic acid octadecylamide copolymer were diluted with 1 liter of Isoper G to prepare a black oil ink.

Thereafter, 2 liter of the thus-prepared Oil Ink (IK-1) was filled in an ink tank of an ink jet drawing device in the drawing device of a printing apparatus shown in FIG. 6. The ejection head used here was a 900 dpi full line head of the type shown in FIG. 17. In the ink tank, an immersion heater and a stirring blade were provided as ink temperature-controlling means and by setting the ink temperature to 30° C., the temperature was controlled using a thermostat while stirring by stirring means. The stirring means used here was a circulation pump and as in FIG. 1, this was commonly used as stirring means of preventing precipitation and coagulation and as liquid feed means to the ejection head. The branch point between a branched large aperture pipeline and a small aperture pipeline had a shape of the type shown in FIG. 2(*a*). A part of the ink passage was made transparent, and an LED light-emitting device and a light-detecting device were disposed to sandwich the transparent portion. Based on the output signal therefrom, the concentration was controlled by charging a diluting solution (Isoper G) for ink or a concentrated ink (2-fold solid concentration of Ink (IK-1)). A rolled fine coated paper as a printing medium was provided on an opposing drum and transported. Dusts on the surface of the printing medium was removed by air pump suction and then, the ejection head was approximated to the printing medium and stopped at the drawing position. The image data to be printed were transmitted to the image data arithmetic and control part and while transporting the printing medium by the rotation of the opposing drum, an oil ink was ejected from the full-line multi-channel head to form an image. At this time, the ejection electrode of the ink jet head had a tip width of 10 $\mu$m, and the head and the printing medium was kept at a distance of 1 mm by the output of an optical gap detecting device. A voltage of 2.5 KV was always applied as a bias voltage and at the time of performing the ejection, a pulse voltage of 500 V was superimposed. The pulse voltage was changed through 256 stages in the range from 0.2 to 0.05 msec so as to perform the drawing while changing the dot area. As a result, good printing was attained, where despite the common use of a pump for stirring and liquid feeding, drawing failure due to dust was not observed at all and the image was completely free of deterioration due to change in the dot size even with change in the ambient temperature or increase in the number of printed sheets.

The image was firmed by heating using a xenon flash fixing apparatus (manufactured by Ushio Denki, emission intensity: 200 J/pulse). After the completion of printing, the ink jet recording device was retreated 50 mm from the position proximate to the drawing drum so as to protect the ink jet head.

The resulting printed matter had a very clear printing image free of slipping or thinning. After the completion of printing, Isoper G was fed to the head and the head was cleaned by dripping Isoper G from the head opening for 10 minutes. Thereafter, the head was stored in a cover filled with vapor of Isoper G, as a result, good printed matters could be prepared without requiring any maintenance operation for 3 months.

Example 2

A printing apparatus shown in FIGS. 7 and 8 was used, where a circulation pump as the stirring means was used as in FIG. 3, the branch point had a shape of the type shown in FIG. 2(*b*), and the confluent point had a shape of the type shown in FIG. 4(*c*). Furthermore, four units of 150-dpi multi-channel heads each having 64 channels of the type shown in FIG. 17 were used and the heads each was disposed to array the ejection parts of 64 channels in the direction right angled to the axial direction of the drum.

The oil ink used was four color inks, namely, black ink IK-1, cyan ink IK-2 prepared in the same manner as IK-1 except for using Phthalocyanine Blue in place of nigrosine used as a coloring material of IK-1, magenta ink IK-3 prepared in the same manner as IK-1 except for using CI pigment red 57:1 in place of nigrosine used as a coloring material of IK-1, and yellow ink IK-4 prepared in the same manner as IK-1 except for using CI pigment yellow 14 in place of nigrosine used as a coloring material of IK-1. These four inks were filled in four heads, respectively.

A heater and the above-described pump were used as the ink temperature-controlling means and the ink temperature was set to 35° C. and controlled by a thermostat.

Also, an electrical conductivity-measuring device was disposed on the ink passage and based on the output signals therefrom, the concentration was controlled by diluting the ink or charging a concentrated ink. After removing dusts on the surface of the printing medium using a nylon-made rotary brush, image data to be printed were transmitted to the image data arithmetic and control part. Then, the head was moved in the axial direction of the drum to perform main scanning and at the same time, sub-scanning was performed while rotating the drawing drum. By this drawing, an ink was ejected on a rolled fine coated paper to form an image.

Despite the common use of a pump for stirring and liquid feeding, drawing failure and the like due to dusts were not observed at all and even with change in the ambient temperature or increase in the number of printed sheets, the image was completely free of deterioration due to change in the dot size and the like. Whichever type of a head shown in FIG. 17 or FIG. 19 was used, good one-side or two-side full color printing could be attained.

After the completion of printing, Isoper G was circulated to the head and thereafter, the head was cleaned by bringing a non-woven fabric impregnated with Isoper G into contact with the head tip. As a result, good printed matters could be prepared without requiring any maintenance operation for 3 months.

Also, the image drawing and printing were performed in the same manner except for using a 150 dpi multi-channel head with 64 channels of the type shown in FIG. 19 in place of the ink jet head of the type shown in FIG. 17, as a result, good results were obtained similarly to the above.

Example 3

Using a printing apparatus shown in FIG. 10, full color printing of one-side four-color printing was performed. A circulation pump was used as the stirring means as shown in FIG. 1 and the branch point between a branched large aperture pipeline and a small aperture pipeline had a shape of the type shown in FIG. 2(*c*). Four color inks described in Example 2 were used as the oil ink in four sets of ink jet drawing devices, respectively, and a 900 dpi image was drawn on coated paper by using 4 units of 100 dpi multi-channel heads with 256 channels of the type shown in FIG. 21 each disposed to array the ejection parts in parallel with the axis of the opposing drum, performing the main scanning by the rotation of the opposing drum, and sequentially moving the heads in the axial direction of the drum every each rotation. As a result, despite the common use of a pump for stirring and liquid feeding, a full color printed matter having a clear and high-quality image was obtained.

Example 4

Using a printing apparatus shown in FIGS. 12 and 13, full color printing of one-side four-color printing was performed. A circulation pump was used as the stirring means as in FIG. 3, the branch point between a branched large aperture pipeline and a small aperture pipeline had a shape of the type shown in FIGS. 2(*c*) and the confluent point had a shape of the type shown in FIG. 4(*c*). The oil inks were the same four color inks as used in Example 3. The ejection head used in this Example was a 600 dpi multi-channel head with 64 channels of the type shown in FIG. 17 and the head was disposed to array the ejection parts at an angle of about 60° with respect to the running direction of the printing medium. The image data to be printed were transmitted to the image data arithmetic and control part and a 700 dpi image was formed on a paper sheet exclusive for ink jet printing by transporting a printing medium using the rotation of capstan rollers while moving the multi-channel head with 64 channels in the direction right angled to the transportation direction of the printing medium. Other operations were the same as in Example 1. As a result, despite the common use of a pump for stirring and liquid feeding, good full color printing of four colors could be attained.

According to the printing process of the present an image is directly formed on a printing medium by an electrostatic ink jet method of ejecting an oil ink using electrostatic field based on signals of image data and then fixed to obtain a printed matter, wherein stirring and feeding of an oil ink can be operated by one unit of a pump and therefore, the printing apparatus can be simplified, miniaturized and reduced in the cost. Of course, since this image formation is performed by an ink jet method of ejecting an oil ink using electrostatic field, the image can be prevented from occurrence of bleeding and fine droplets can be ejected even if an expensive exclusive paper sheet is not used and printing is performed on a normal printing paper or a non-absorptive medium such as plastic sheet, so that individual dot images obtained can be reduced in the area and in the thickness and therefore, high-grade printing of image information comparable to a photographic image can be performed inexpensively and quickly.

The entire disclosure of each and every foreign patent application from which the benefit of foreign priority has been claimed in the present application is incorporated herein by reference, as if fully set forth.

What is claimed is:

1. An ink jet printing process for forming an image directly on a printing medium by an electrostatic ink jet method of ejecting an oil ink using electrostatic field based on signals of image data and preparing a printed matter by fixing the image, wherein the process uses:

an ink tank for storing the oil ink;

an ink circulation line for stirring the oil ink stored in the ink tank, said ink circulation line having a large aperture; and an ink feed line for feeding the oil ink to an ink jet ejection head, said ink feed line being branched from the ink circulation line and having a small aperture, wherein the ink is circulated to the ink circulation line to simultaneously perform the stirring of the ink stored in the ink tank and the feeding of the ink to the ink jet ejection head.

2. The ink jet printing process according to claim 1, wherein an ink recovery line for recovering the oil ink from the ink jet ejection head, connected to the ink circulation line, is provided and the ink is circulated to the ink circulation line to recover the ink from the ink jet ejection head.

3. An ink jet printing apparatus comprising image-forming means for forming an image directly on a printing medium based on signals of image data and image-fixing means for fixing the image formed by the image-forming means to obtain a printed matter, the image-forming means being an ink jet drawing device of ejecting an oil ink from an ejection head using an electrostatic field, wherein the image-forming means comprises:

an ink jet ejection head;

ink feed means for feeding the oil ink to the ink jet ejection head;

an ink tank for storing the oil ink; and an ink circulation means for stirring the oil ink stored in the ink tank, wherein the ink is circulated to an ink circulation line to simultaneously perform the stirring of the ink stored in the ink tank and the feeding of the ink to the ink ejection head.

4. The ink jet printing apparatus according to claim 3, wherein ink recovery means for recovering the oil ink from the ink jet ejection head is provided and the ink recovery means is connected to the ink circulation means.

5. The ink jet printing apparatus according to claim 3, wherein the image-forming means has a fixing apparatus for fixing the ink.

6. The ink jet printing apparatus according to claim 3, which comprises dust-removing means for removing dust present on the surface of the printing medium before and/or during the printing on the printing medium.

7. The ink jet printing apparatus according to claim 3, wherein at the time of drawing an image on the printing medium, the drawing is performed by rotating an opposing drum disposed at the position facing the ejection head through the printing medium and thereby moving the printing medium.

8. The ink jet printing apparatus according to claim 7, wherein the ejection head comprises a single channel head or a multi-channel head and the drawing is performed by moving the head in the direction parallel to the axis of the opposing drum.

9. The ink jet printing apparatus according to claim 7, wherein the ejection head comprises a full line head having almost the same length as the width of the printing medium.

10. The ink jet printing apparatus according to claim 3, wherein at the time of drawing an image on the printing medium, the drawing is performed by running the printing medium while interposing and holding it between at least a pair of capstan rollers.

11. The ink jet printing apparatus according to claim 10, wherein the ejection head comprises a single channel head or a multi-channel head and the drawing is performed by moving the ejection head in the direction orthogonal to the running direction of the printing medium.

12. The ink jet printing apparatus according to claim 10, wherein the ejection head comprises a full line head having almost the same length as the width of the printing medium.

13. The ink jet printing apparatus according to claim 3, wherein the ink jet drawing device has ink temperature-controlling means for controlling the temperature of the oil ink in the ink tank for storing the oil ink.

14. The ink jet printing apparatus according to claim 3, wherein the ink jet drawing device has ink concentration-controlling means for controlling the concentration of the oil ink.

15. The ink jet printing apparatus according to claim 3, which comprises cleaning means for cleaning the ejection head.

16. The ink jet printing apparatus according to claim 3, wherein said ink circulation means has a large aperture, and the ink feed means is branched from the ink circulation means and has a small aperture.

* * * * *